US009115572B1

(12) United States Patent
Hardesty et al.

(10) Patent No.: US 9,115,572 B1
(45) Date of Patent: Aug. 25, 2015

(54) EXTERNALLY-ORIENTATED INTERNALLY-CORRECTED PERFORATING GUN SYSTEM AND METHOD

(71) Applicant: GEODynamics, Inc., Millsap, TX (US)

(72) Inventors: John T. Hardesty, Weatherford, TX (US); Nathan G. Clark, Mansfield, TX (US); James A. Rollins, Lipan, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/599,069

(22) Filed: Jan. 16, 2015

(51) Int. Cl.

| | |
|---|---|
| ***E21B 43/118*** | (2006.01) |
| ***E21B 43/119*** | (2006.01) |
| ***E21B 23/01*** | (2006.01) |
| ***E21B 43/117*** | (2006.01) |

(52) U.S. Cl.
CPC ..... *E21B 43/118* (2013.01); *E21B 23/01* (2013.01); *E21B 43/117* (2013.01); *E21B 43/119* (2013.01)

(58) Field of Classification Search
CPC ... E21B 43/112; E21B 43/114; E21B 43/116; E21B 43/117; E21B 43/118; E21B 43/1185; E21B 43/11852; E21B 43/11855; E21B 43/11857; E21B 43/119; E21B 43/1195; E21B 43/12
See application file for complete search history.

(56) References Cited

U.S. PATENT DOCUMENTS

| | | | | |
|---|---|---|---|---|
| 4,153,118 | A * | 5/1979 | Hart | 175/4.51 |
| 4,194,577 | A * | 3/1980 | Vann | 175/4.51 |
| 4,269,278 | A * | 5/1981 | Vann | 175/4.51 |
| 4,637,478 | A * | 1/1987 | George | 175/4.51 |
| 5,107,927 | A * | 4/1992 | Whiteley et al. | 166/50 |
| 6,354,219 | B1 * | 3/2002 | Pratt et al. | 102/307 |
| 2002/0185275 | A1 * | 12/2002 | Yang et al. | 166/297 |
| 2003/0098158 | A1 * | 5/2003 | George et al. | 166/297 |
| 2003/0188867 | A1 * | 10/2003 | Parrott et al. | 166/297 |
| 2004/0104029 | A1 * | 6/2004 | Martin | 166/298 |
| 2004/0231859 | A1 * | 11/2004 | Huber et al. | 166/381 |
| 2010/0230163 | A1 * | 9/2010 | Hales et al. | 175/4.51 |
| 2013/0118342 | A1 * | 5/2013 | Tassaroli | 89/1.15 |

* cited by examiner

*Primary Examiner* — Blake Michener
(74) *Attorney, Agent, or Firm* — David W. Carstens; Sudhakar V. Allada; Carstens & Cahoon, LLP

(57) ABSTRACT

An externally-oriented internally-corrected perforating gun system and method for accurate perforation in a deviated wellbore is disclosed. The system/method includes a gun string assembly (GSA) deployed in a wellbore with an external protuberance member (EPM) and an internal pivot support (IPS). With the EPM oriented to the high side of the wellbore, the center of mass of the GSA positions the GSA at the lower side of the wellbore surface. The IPS is attached to internal gun components such end plate, charge holder tube, detonating cord or charge case. The charges inside the charge holder tube move with the gravitational vector about the IPS and point more accurately in the desired direction for perforating. The external orientation of the EPM along with limited internal swing about the IPS provide for an accurate orientation of the charges that results in efficient and effective perforating through a hydrocarbon formation.

21 Claims, 20 Drawing Sheets

EXTERNALLY-ORIENTATED INTERNALLY-CORRECTED PERFORATING GUN SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT FEDERALLY SPONSORED RESEARCH OR DEVELOPMENT

Not Applicable

REFERENCE TO A MICROFICHE APPENDIX

Not Applicable

PRIOR ART AND BACKGROUND OF THE INVENTION

1. Field of the Invention

The present invention generally relates orienting perforating guns in oil and gas extraction. Specifically, the invention attempts to externally orient perforating guns in a desired direction with an external member and internally correcting with a pivot mechanism.

2. Prior Art Background

The process of extracting oil and gas typically consists of operations that include preparation, drilling, completion, production, and abandonment.

Preparing a drilling site involves ensuring that it can be properly accessed and that the area where the rig and other equipment will be placed has been properly graded. Drilling pads and roads must be built and maintained which includes the spreading of stone on an impermeable liner to prevent impacts from any spills but also to allow any rain to drain properly.

In the drilling of oil and gas wells, a wellbore is formed using a drill bit that is urged downwardly at a lower end of a drill string. After drilling the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

A gun string assembly is positioned in an isolated zone in the wellbore casing. The gun string assembly comprises a plurality of perforating guns coupled to each other either through tandems or subs. The perforating gun is then fired, creating holes through the casing and the cement and into the targeted rock. These perforating holes connect the rock holding the oil and gas and the well bore.

The perforating gun comprises a conveyance for the shaped charges such as a hollow carrier, a tube to align and hold the shaped charges (charge holder tube), charge holder tube end plates, shaped charges, detonating cord, and the detonator. In deviated/horizontal wellbore perforating applications, it is sometimes desirable to orient the direction of the perforation tunnels within the wellbore, so that more perforations can be concentrated in a particular direction with respect to a deviated/horizontal wellbore, either up, down, up and down, or to one side or the other.

Prior Art System External Orientation Overview (0100)

As generally seen in the system diagram of FIG. 1 (0100), prior art systems associated with perforation gun assemblies include a wellbore casing (0120) laterally drilled into a wellbore. A gun string assembly (GSA) comprising plural perforating guns (0101, 0102) with detonation train is positioned in a hydrocarbon fracturing zone. The guns may be coupled to each other with a tandem (0104). External methods, where a fin or a protuberance (0103) from the perforating gun causes the center of mass of the assembly to be such that the perforating gun tends to be on the low side of the wellbore casing and oriented with the fins to the high side of the wellbore as the guns are pumped down or pulled up the well. This method is primarily used with wireline pump down perforating method of conveyance. This method has the advantage of being a low cost solution, but the disadvantage of being a less accurate means of orienting the charges. As illustrated in FIG. 1*b*, a gun string is oriented at an angle to the desired orientation. Typical accuracy is at best +/−15 degrees from the desired orientation. Fractures will initiate and propagate in the preferred fracture plane of the formation. Oriented perforating systems can be used to more closely align a plane of perforation tunnels with a preferred fracture plane. Misalignment between the preferred fracture plane and perforations in a well can result in significant pressure drop due to tortuosity in the flow path near the wellbore as shown in FIG. 2*a* (0230). As generally illustrated in FIG. 2*a* (0230) and FIG. 2*b* (0240), a preferred fracture plane (PFP) is shown in relation to perforation orientation of the perforation charges. The perforations that are phased at 90 degrees to the PFP create pinch points resulting in pressure loss and high tortuosity in the flow path. FIG. 2*c* (0250) illustrates perforations that are at 0 degrees and 180 degrees to the preferred fracture plane and FIG. 2*c* (0260) shows perforations that are phased at 90 degrees to the PFP.

Hydrocarbon fracturing tunnels have certain preferred orientations where the effectiveness of extracting oil/gas is greatest i.e., when a perforation is aligned along the tunnels, oil/gas flows though the perforation tunnels without taking an alternate path that may become a restrictive path creating high tortuosity conditions.

Therefore, there is a need for a better than +/−15 degrees accuracy to reduce tortuosity and increase well performance.

Prior Art System Internal Orientation Overview (0300)

As generally seen in FIG. 3 (0300), the internal components of the gun are allowed to turn 360 degrees (0720), and are weighted to turn in a preferred direction. The charge case may be part of the weighting mechanism. This method has the advantage of greater accuracy, but can add significant cost to the entire gun assembly, as bearings and rollers are needed to allow rotation of the internal structure with limited available force. In addition, the bearings and rolling mechanism may fail to turn, either through binding from friction or binding due to thermal expansion, or because the gun may be slightly bent due to variation in the well straightness. In this case, the charges may shoot in any random direction and result in well performance worse than may have been achieved with conventional spiral phased charges which require no orientation. Therefore, there is a need to prevent perforation in a random direction used in conventional bearings and roller mechanism.

For a pump down select fire application, full rotation (360°) prevents the use of a through wire to connect subsequent select fire switches to the firing train. The rotating internal components may sever the wire, or require a rotating junction, both of which decrease reliability of the gun system. Therefore there is a need for a limited internal motion gun that would allow the wire to be positioned such that no pinch point exists.

Finally, the bearings and weights required for these systems often reduce the maximum possible charge size, and lower gram weight charges may be needed than would be used in a conventional system of equivalent diameter.

Therefore, there is a need for maximizing charge size in order to achieve maximum perforation efficiency.

In addition, there is a need for maximizing the number of charges by using the length of the perforating guns to maximize shot density.

Furthermore, there is a need for charges to adjust to deviations in the wellbore casing or straightness in perforating gun to orient the charges in a desired orientation for perforation.

Deficiencies in the Prior Art

The Prior Art as Detailed Above Suffers from the following deficiencies:

- Prior art systems do not provide for a better than +/−15 degrees accuracy to reduce tortuosity and increase well performance.
- Prior art systems do not provide for preventing perforation in a random direction used in conventional bearings and roller mechanism.
- Prior art systems do not provide for maximizing charge size in order to achieve maximum perforation efficiency.
- Prior art systems do not provide for maximizing the number of charges by using the length of the perforating guns to maximize shot density.
- Prior art systems do not provide for adjusting to deviations in the wellbore casing or straightness in perforating gun to orient the charges in a desired orientation for perforation.
- Prior art systems do not provide for a reliable and simple thorough wire to enable select fire systems with external or internal swiveling orienting guns.

While some of the prior art may teach some solutions to several of these problems, the core issue of externally orienting perforating guns with limited internal correction has not been addressed by prior art.

OBJECTIVES OF THE INVENTION

Accordingly, the objectives of the present invention are (among others) to circumvent the deficiencies in the prior art and affect the following objectives:

- Provide for a better than +/−15 degrees accuracy to reduce tortuosity and increase well performance.
- Provide for preventing perforation in a random direction used in conventional bearings and roller mechanism.
- Provide for maximizing charge size in order to achieve maximum perforation efficiency.
- Provide for maximizing the number of charges by using the length of the perforating guns to maximize shot density.
- Provide for adjusting to deviations in the wellbore casing or straightness in perforating gun to orient the charges in a desired orientation for perforation.
- Provide for a reliable and simple thorough wire to enable select fire systems with external or internal swiveling orienting guns While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The present invention provides an externally-oriented internally-corrected system that includes a gun string assembly (GSA) deployed in a wellbore with an external protuberance member (EPM) and an internal pivot support (IPS). The EPM is oriented to the high side of the wellbore so that the center of mass of the GSA positions the GSA at the lower side of the wellbore surface. The internal components of the GSA swing/swivel from the IPS such that the charges are oriented towards a desired perforating orientation. The charges inside the GSA move with the gravitational vector and point more accurately in the desired direction for perforating. The external orientation of the EPM along with limited internal swing about the IPS provide for an accurate orientation of the charges for perforating through a hydrocarbon formation.

Method Overview

The present invention system may be utilized in the context of an overall gas extraction method, wherein the externally-oriented internally-corrected perforating gun system as described previously is controlled by a method having the following steps:

(1) positioning said GSA along with the EPM and the IPS in a wellbore casing;

(2) orienting coarsely with the EPM in the desired perforating orientation within the coarse angular range;

(3) correcting finely with the IPS in the desired perforating orientation within the fine angular range; and (4) perforating with the GSA into a hydrocarbon formation.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
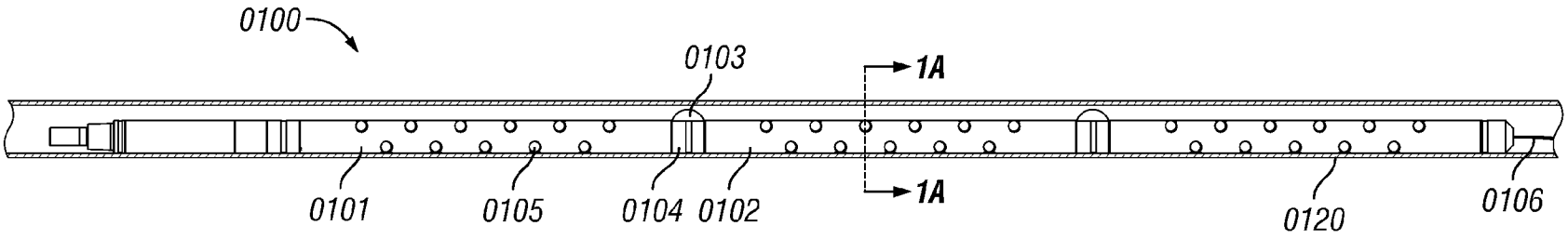
FIG. 1 illustrates a system cross-section overview diagram describing how prior art systems use gun string assemblies to perforate with externally oriented fins.
Figure 1A:
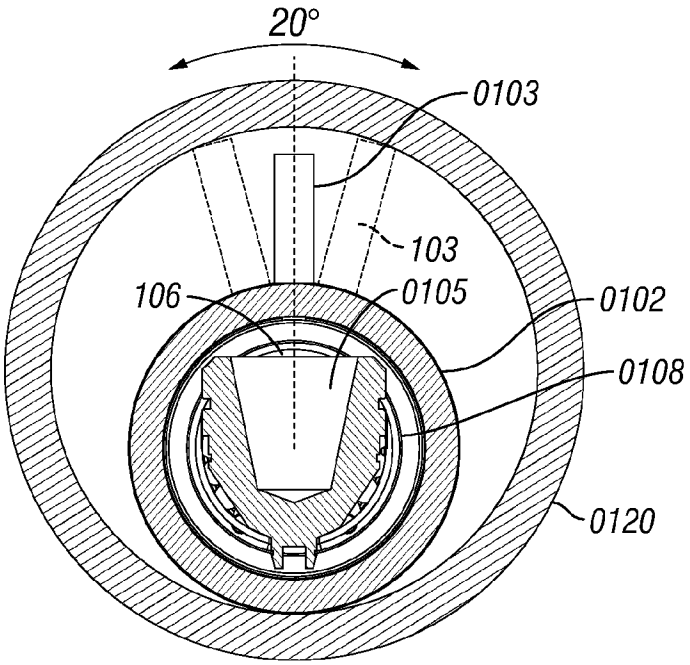
FIG. 1A (Prior Art)
FIG. 1*a* illustrates a system end view diagram describing how prior art systems use gun string assemblies to perform oriented perforation with externally oriented fins.
Figure 1B:
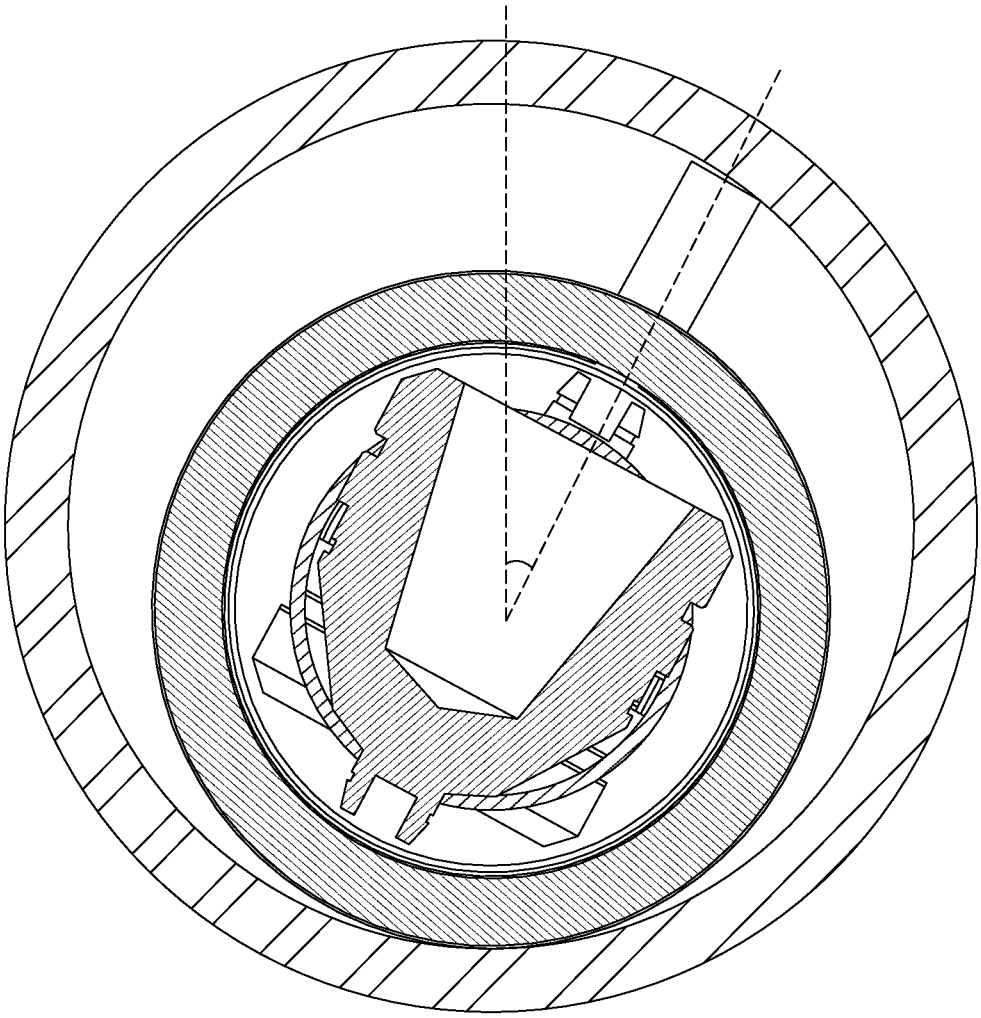
FIG. 1B (Prior Art)
FIG. 1*b* illustrates a system end view diagram describing how prior art systems orient at an angle to a preferred orientation with externally oriented fins.
Figure 2A:
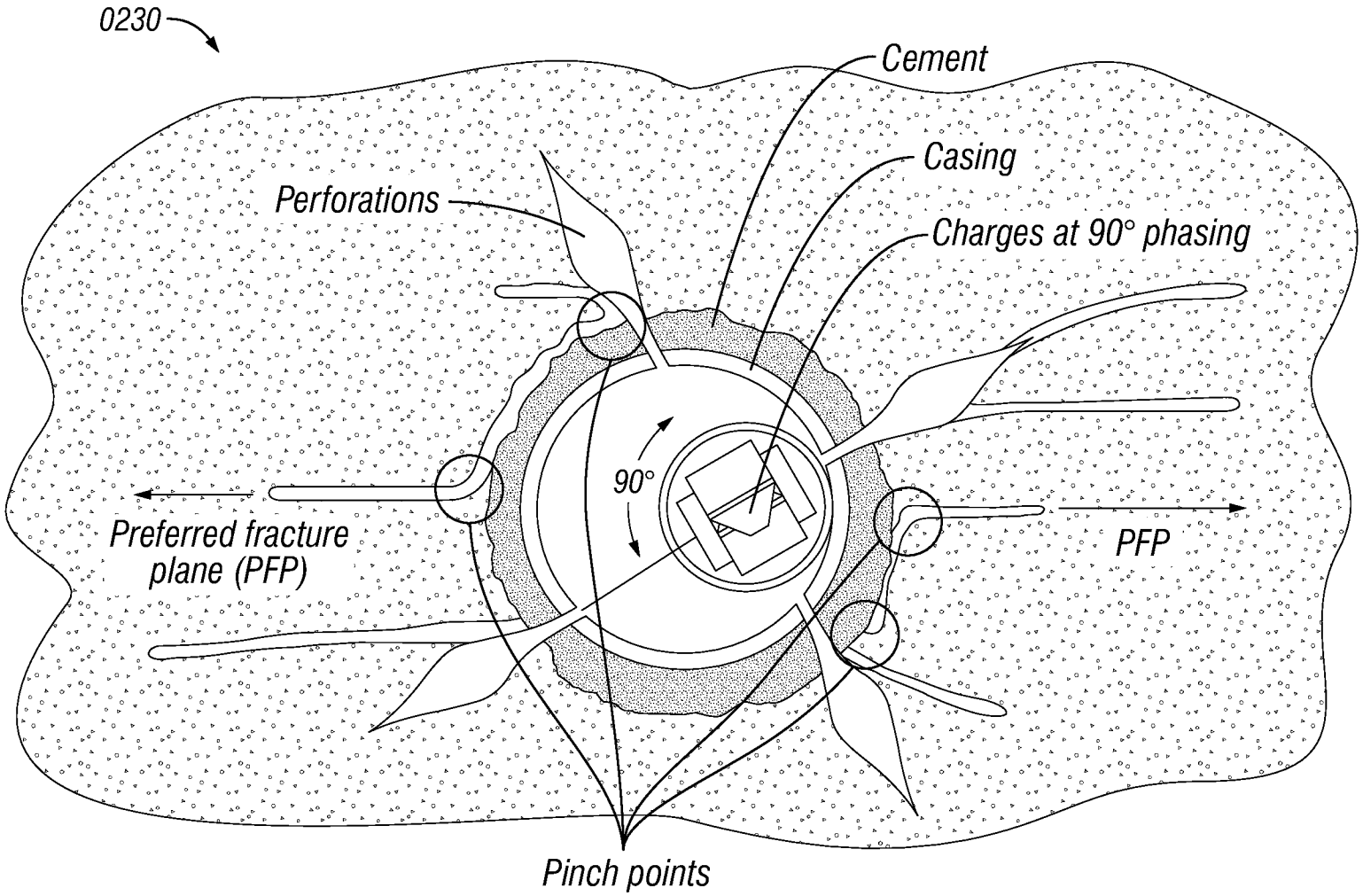
FIG. 2A (Prior Art)
FIG. 2*a* illustrates relationship between preferred fracture plane (PFP) and perforation orientation.
Figure 2B:
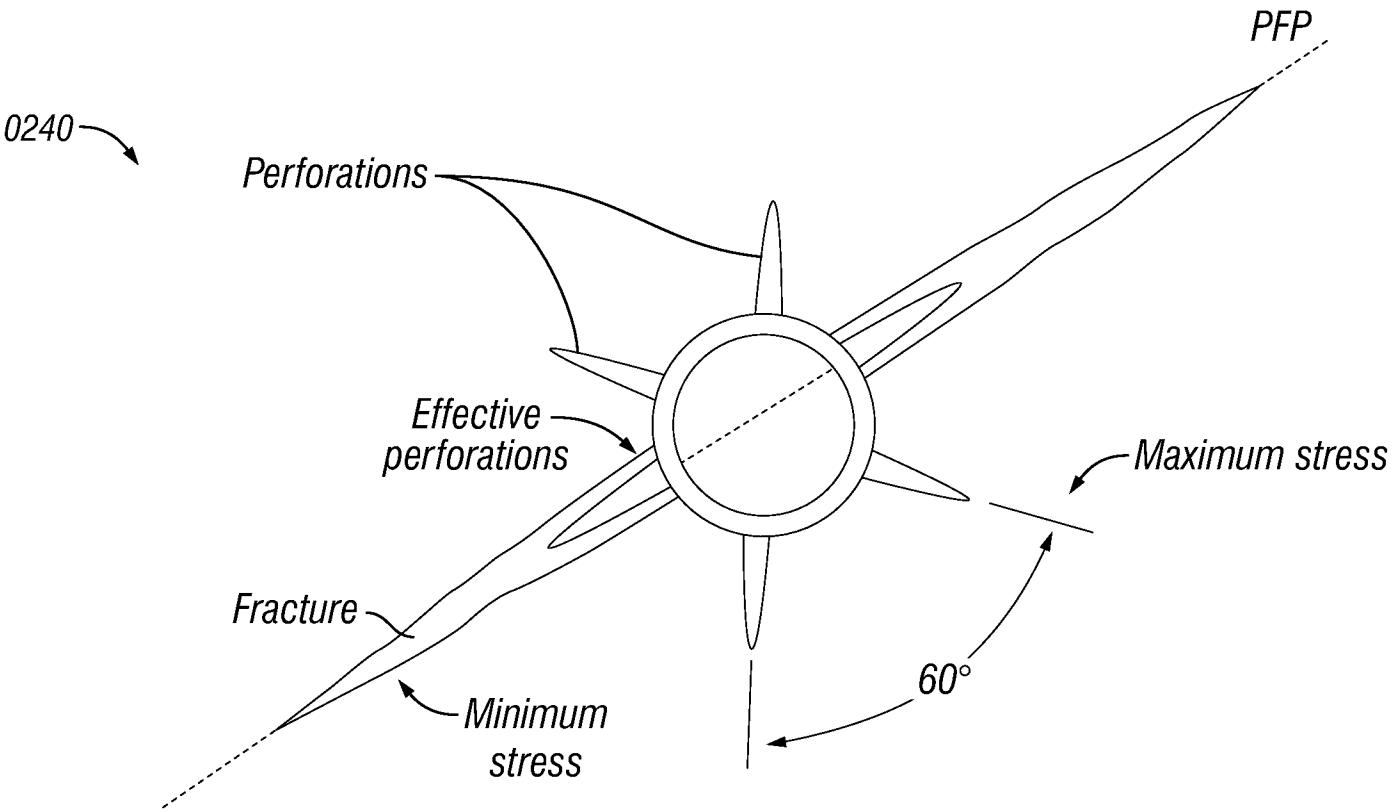
FIG. 2B (Prior Art)
FIG. 2*b* illustrates relationship between preferred fracture plane (PFP) and perforation orientation.
Figure 2C:
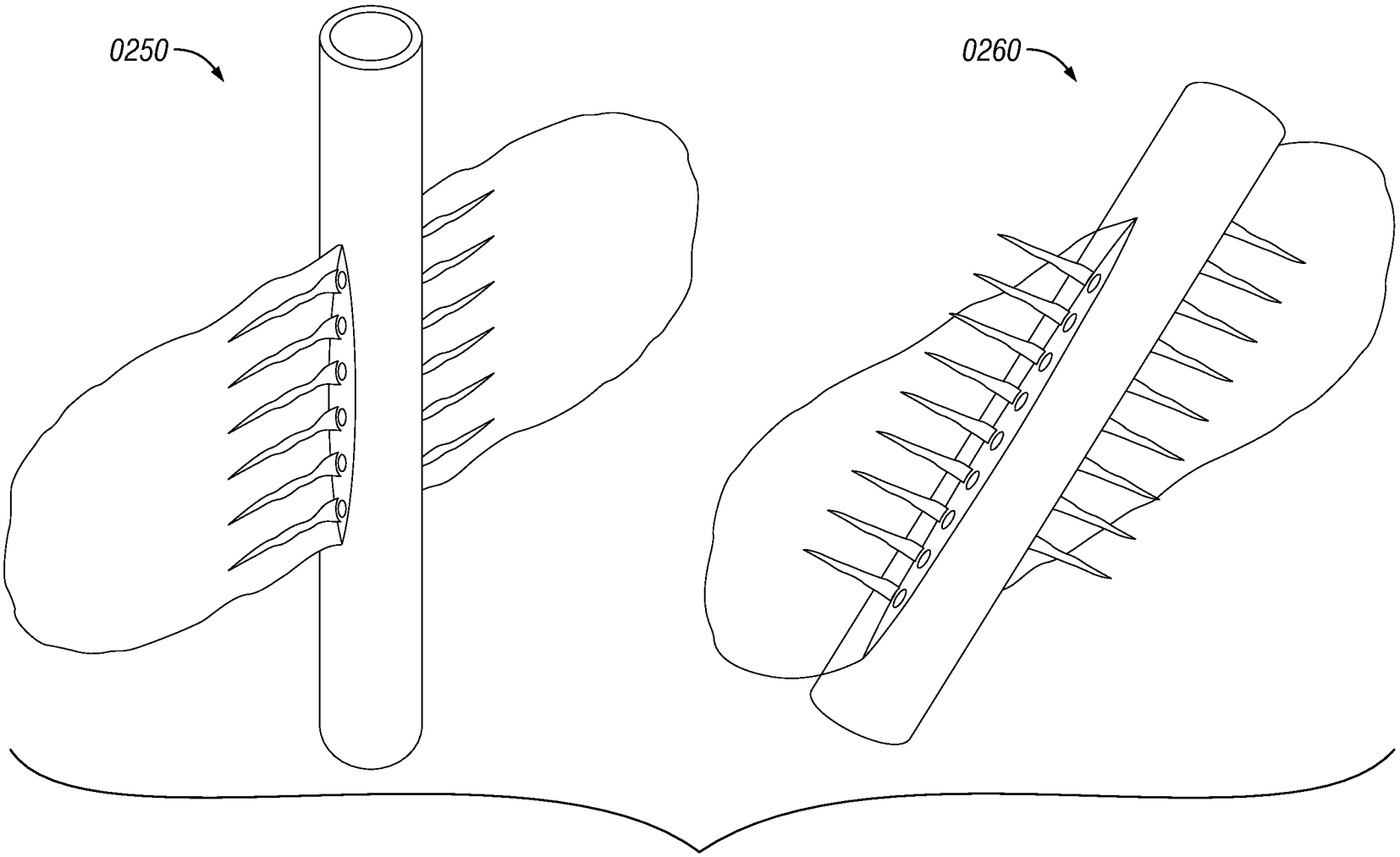
FIG. 2C (Prior Art)
FIG. 2*c* illustrates perforation orientation at 0 degrees and 180 degrees to a preferred fracture plane (PFP).
Figure 3:
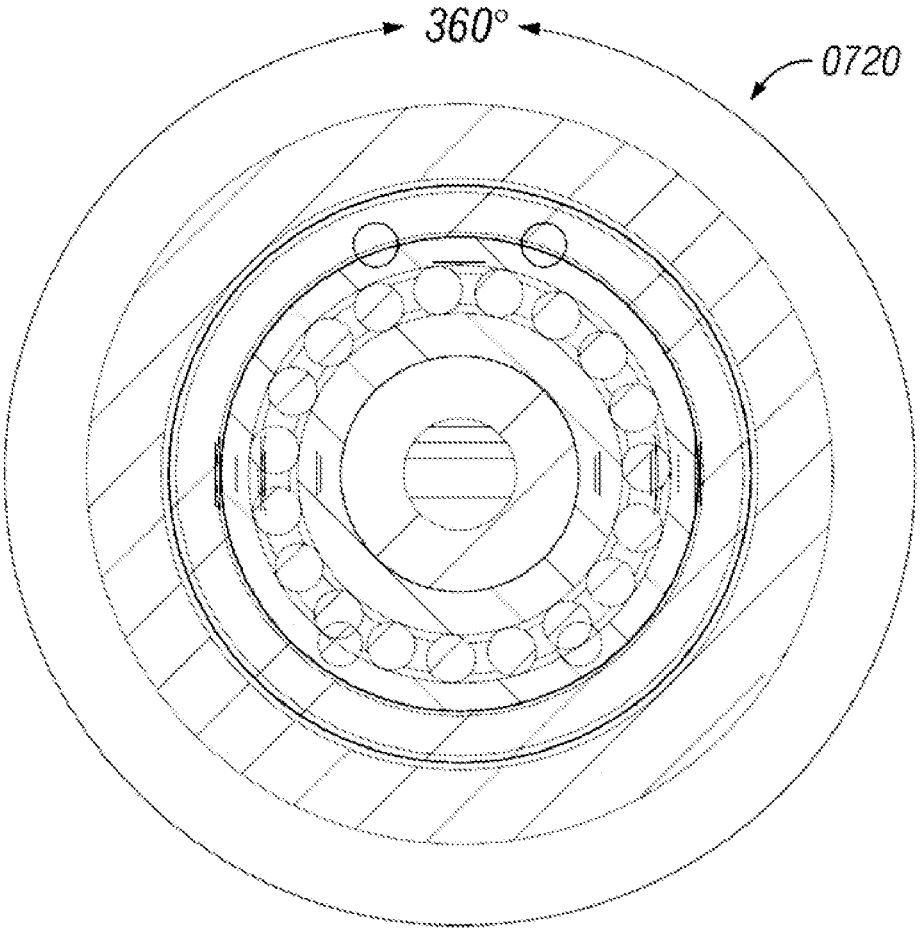
FIG. 3 (Prior Art)
FIG. 3 illustrates a system end view diagram illustrating how prior art systems use gun string assemblies to perform oriented perforation with internal ball bearing mechanism that rotate 360 degrees.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of an externally oriented perforation gun system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Preferred Exemplary System Block Diagram of an Oriented Wellbore Perforation with an External Protuberance Member (EPM) in Conjunction with an Internal Pivot Support (IPS) (0400)

Figure 4:
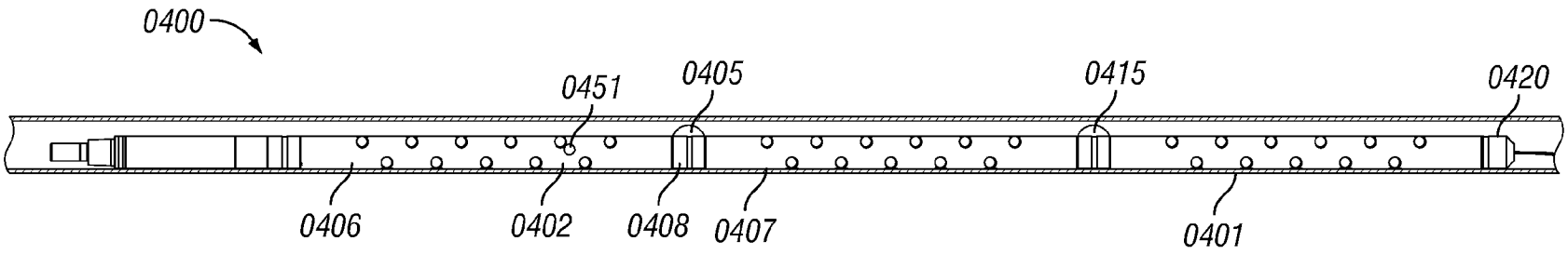
FIG. 4 illustrates an exemplary system side views depicting an external protuberance member (EPM) mounted on a finned sub in conjunction with an internal pivot support (IPS) to perform oriented perforation according to a preferred embodiment of the present invention.
Figure 4A:
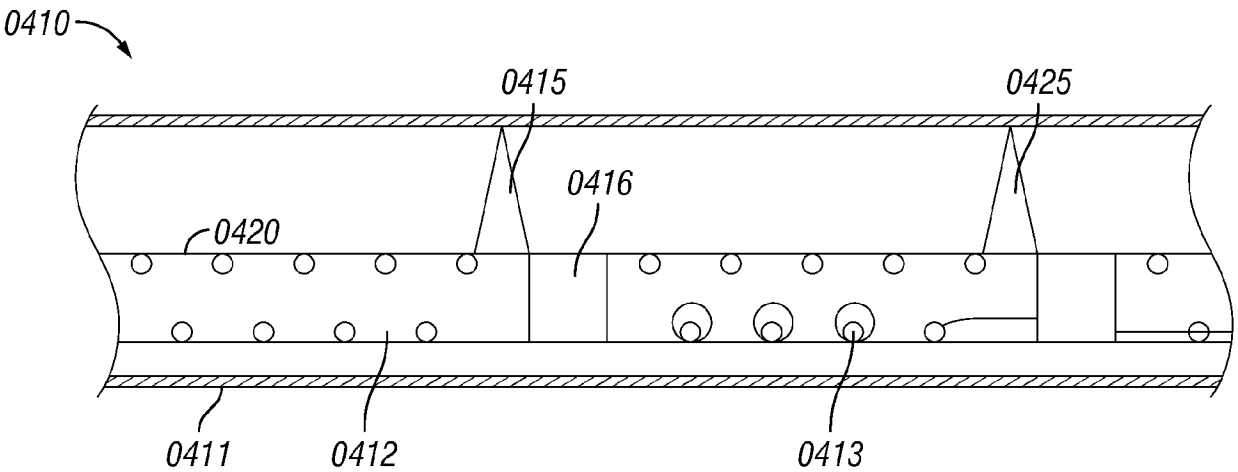
FIG. 4*a* illustrates an exemplary system side views depicting an external protuberance member (EPM) mounted on perforating guns according to a preferred embodiment of the present invention.

The present invention may be seen in more detail as generally illustrated in FIG. 4 (0400), wherein a gun string assembly (GSA) (0420) is deployed inside a wellbore casing (0401) along with an integrated external protuberance member (EPM) (0405). After a stage has been isolated for perforation, a perforating gun string assembly (GSA) (0420) may be deployed and positioned in the isolated stage. The GSA (0420) may include a string of perforating guns mechanically coupled to each other through tandems or subs or transfers. For example, perforating gun (0406) may be coupled to perforating gun (0407) via a connecting element such as a tandem, transfer, sub, or finned sub (0408). In a typical GSA, multiple perforating guns may be coupled in a cascading mode. According to a preferred exemplary embodiment, an external protuberance member (EPM) (0405) may be mounted/attached to the sub (0408) to externally orient the gun in an upward direction facing the inside surface of the well casing. After a GSA (0420) is pumped into the wellbore casing (0401), the GSA (0420) may position on the bottom surface of the casing due to gravity and point upwards as a result of the EPM (0405) orientation. According to a preferred exemplary embodiment, the EPM (0405) orients the GSA (0420) such that the charges (0404) inside a charge holder tube (CHT) are coarsely aligned within +/−20 degrees (coarse angular range) of the preferred/desired perforation/perforating orientation. According to a preferred exemplary embodiment, the EPM (0405) may be shaped to conform to the outside surface of the finned sub (0408). For example, the EPM (0405) may be elongated, conical or tapered shaped or any other shape that conforms to the outside surface of the finned sub (0408). According to another preferred exemplary embodiment, the EPM (0405) may also be mounted on the outside surface of the perforating guns (0406, 0407) as illustrated in FIG. 4*a*. According to yet another preferred exemplary embodiment, the EPM coarsely orients the GSA within 30+/−15 degrees of the desired perforating orientation. According to a further preferred exemplary embodiment, the EPM coarsely orients the GSA within +/−12.5 degrees of the desired perforating orientation. According to a most preferred exemplary embodiment, the EPM coarsely orients the GSA within +/−10 degrees of said desired perforating orientation.

FIG. 4*a* (0410) illustrates a GSA (0420) installed inside a wellbore casing (0411). The GSA (0420) may include a string of guns (0412, 0413) mechanically coupled to each other through tandem (0416) or a transfer. The EPMs (0415) and (0425) are mounted on perforating guns (0412) and (0413) respectively. This arrangement may enable the EPMs to be placed at either end of the perforating gun, at the middle or, at the vicinity of the tandem (0416). The EPMs may be spaced evenly or randomly as required by the weight distribution of the GSA arrangement. For example, the EPM (0415) may be attached at the lighter end of the perforating gun (0412) so as to balance the weight of the gun and aid in the accurate orientation of the GSA. Similarly, EPM (0425) may be attached to the middle of the perforating gun (0413). This configuration may not limit spacing between the EPMs to the spacing between the tandems as illustrated in FIG. 4 (0400).

According to yet another preferred exemplary embodiment the EPM (0415) and the EPM (0425) may be slightly offset angularly to enable more accuracy to the preferred orientation. The offset may be used to account for differences in orientations of the guns. For example, an angular offset of 1 to 2 degrees may be used between the EPM (0415) and the EPM (0425).

Preferred Exemplary Internal Pivot System Embodiment (0500)

Figure 5B:
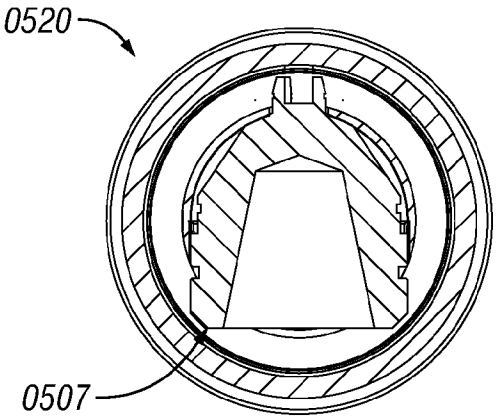
FIG. 5*b* illustrates an exemplary system cross section view of a shaped charge to perform oriented perforation according to a preferred embodiment of the present invention.
Figure 5A:
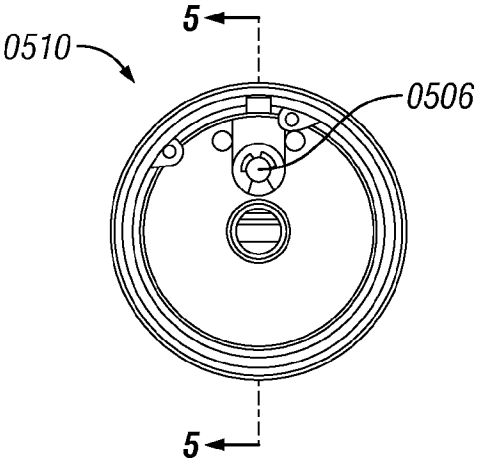
FIG. 5*a* illustrates an exemplary system cross section view an internal pivot support (IPS) to perform oriented perforation according to a preferred embodiment of the present invention.
Figure 5:
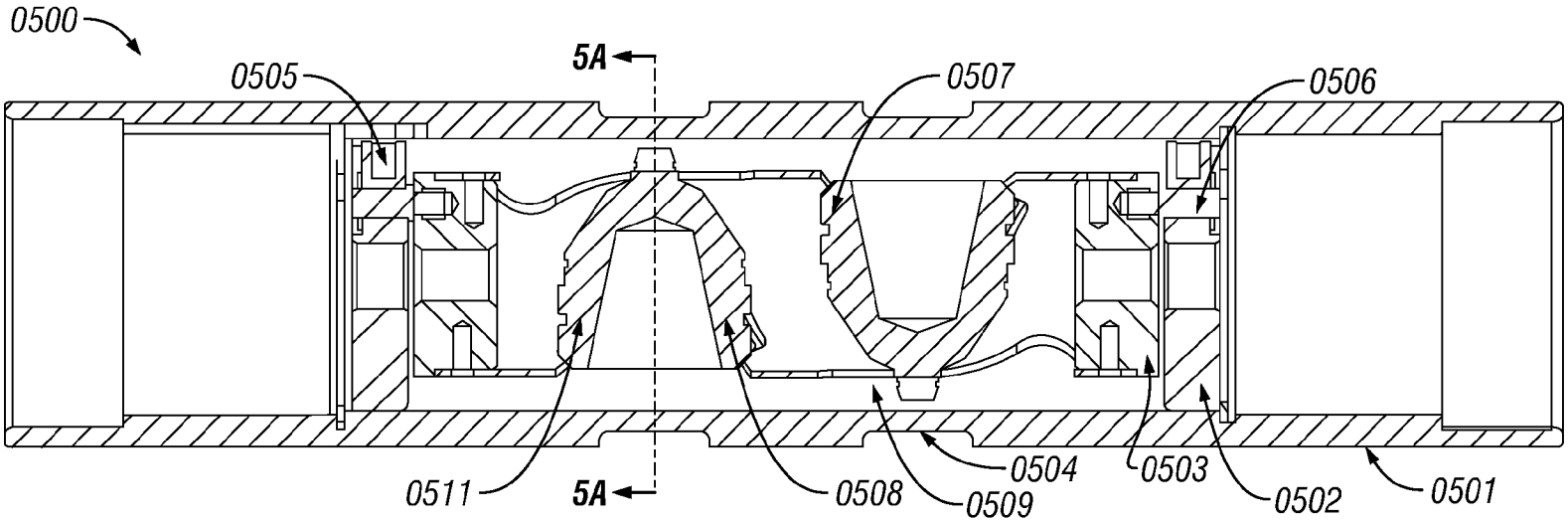
FIG. 5 illustrates an exemplary system cross section view an internal pivot support (IPS) to perform oriented perforation according to a preferred embodiment of the present invention.

As generally illustrated in FIG. 5 (0500), a perforating gun (0501) comprising a charge holder tube (CHT) (0509) carrying energetic charges (0507, 0508) is shown. It should be noted that 2 charges are shown for illustration purposes only and may not be construed as a limitation. One skilled in the art would appreciate that any number of charges may be used in a perforating gun. The charge holder tube is held by a 2-part end plate comprising a fixed end plate (0502) and a swinging/movable end plate (0503). The fixed end plate (0502) may be mechanically aligned to the gun barrel with an alignment pin (0505). The swinging end plate (0503) swivels about an internal pivot support (IPS) (0506) that is higher than the center of gravity of the charge holder tube. According to an exemplary embodiment, the IPS orients the charge holder tube and the charges to within +/−5 degrees of the preferred perforating orientation. According to an exemplary embodiment, the internal pivot support swivels plural energetic charges in the perforating gun within a limited arc such that the plural energetic charges are aligned within a finer angular range in said desired perforating orientation. The shaped charges may perforate through scallops (0504). The limited arc may be within the range of +/−5 degrees. According to a further exemplary embodiment, the finer angular range may be within +/−5 degrees. The IPS (0506) may be a pivot pin with one end attached/welded to the interior surface of the fixed end plate (0502) and the other end is used to suspend the CHT with the swinging end plate (0503). According to an exemplary embodiment, the IPS (0506) is operatively integrated to the end plate of the charge holder tube. According to a further exemplary embodiment, the IPS (0506) is operatively integrated directly to the charge holder tube. The IPS (0506) may also be integrated to other gun components such as the charge case (0511) or pivoting charge clip. The IPS (0506) may orient itself in the direction of the EPM to finely correct the coarse orientation of the EPM. It may be noted that the IPS (0506) may be attached/welded to the fixed end plate (0502) with elements such as knobs, hooks, catches, pegs etc. According to a preferred exemplary embodiment the IPS (0506) may be a gimbal that allows limited rotational movement along an arc that may be limited to 30 degrees. In another preferred exemplary embodiment, IPS (0506) may be suspended by a trapeze that allows limited rotational/swivel movement. In the case of a failure of the mechanism of the internal orientation, the limited movement restricts the orientation angle to within a restrictive arc preventing random perforation orientation. According to a preferred exemplary embodiment, the combination of an external protuberance member along with an internal correction by the IPS (0506) results in an accurate orientation of the charges within +/−5 degrees of the preferred direction. Prior art systems do not provide for combining external orientation elements with internal correction to accurately orient perforation guns without the use of bearings/weights mechanisms. According to a preferred exemplary embodiment, bearings and weights are not required to internally correct with the IPS and therefore maximum possible charge size may be used. Additionally, the present preferred exemplary embodiment maximizes the number of charges and shot density by using the entire length of the perforating guns. The IPS (0506) and the EPM may be made of a material such as metal that can resist the temperature and pressure conditions of the wellbore and wellbore fluids. For example the material could be steel, aluminum, composite, plastic etc.

FIG. 5*a* (0510) generally illustrates an end view of the perforating gun showing the pivot (0506) that limits the swivel of the charge holder tube and the charges. FIG. 5*b* (0520) generally illustrates a cross section of the energetic charge (0507) that swivel about the pivot.

According to a preferred exemplary embodiment, the internal pivot support (IPS) is shaped as a gimbal. According to another preferred exemplary embodiment, the internal pivot support is shaped as a trapeze.

Figure 6:
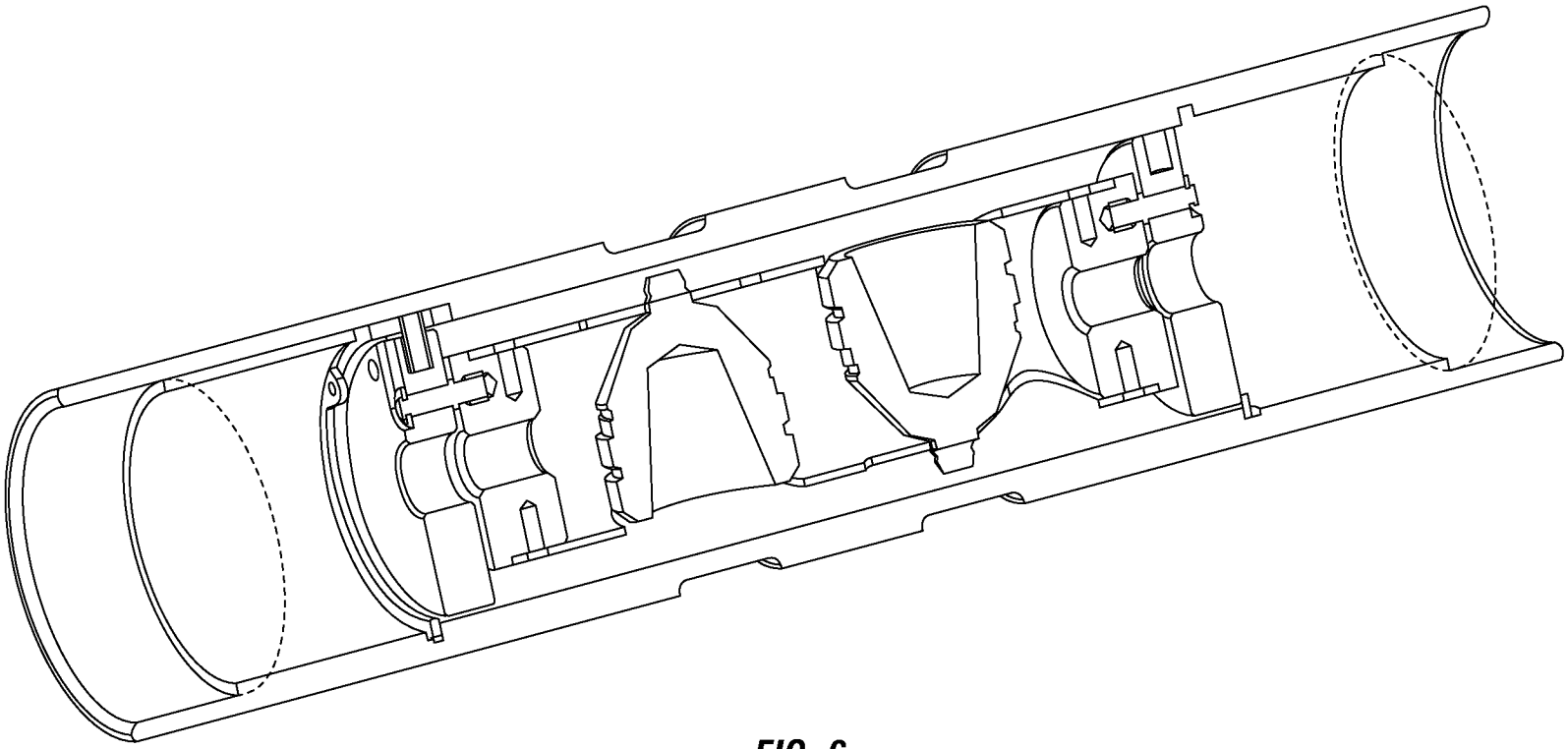
FIG. 6 illustrates an exemplary perspective view an internal pivot support (IPS) to perform oriented perforation according to a preferred embodiment of the present invention.

FIG. 6 shows a perspective view of perforating gun showing the pivot (0506) that limits the swivel of the charge holder tube and the energetic charges.

Preferred Exemplary Internal Bearing Race System Embodiment (0700-0800)

Figure 7:
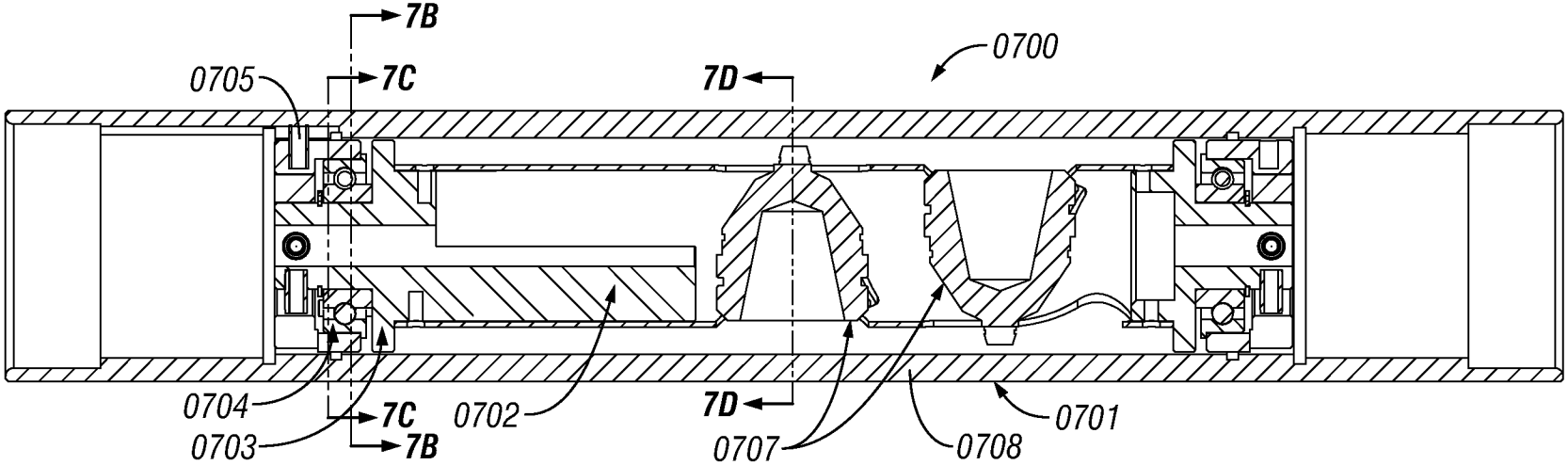
FIG. 7, 7*a*, 7*b*, 7*c*, 7*d* illustrates cross sections of limited internal rotation with ball bearing race to perform oriented perforation according to a preferred embodiment of the present invention.
Figure 7A:
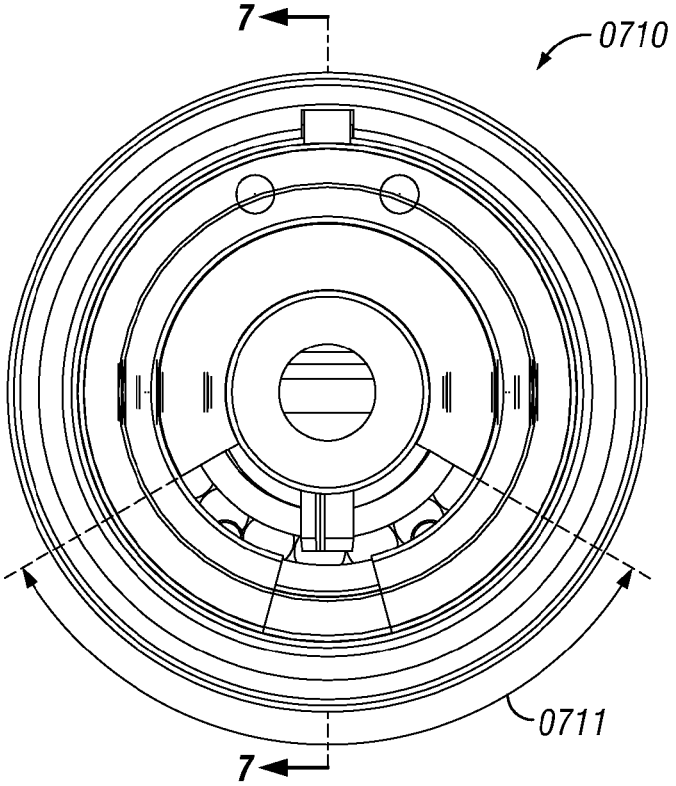
Figure 7B:
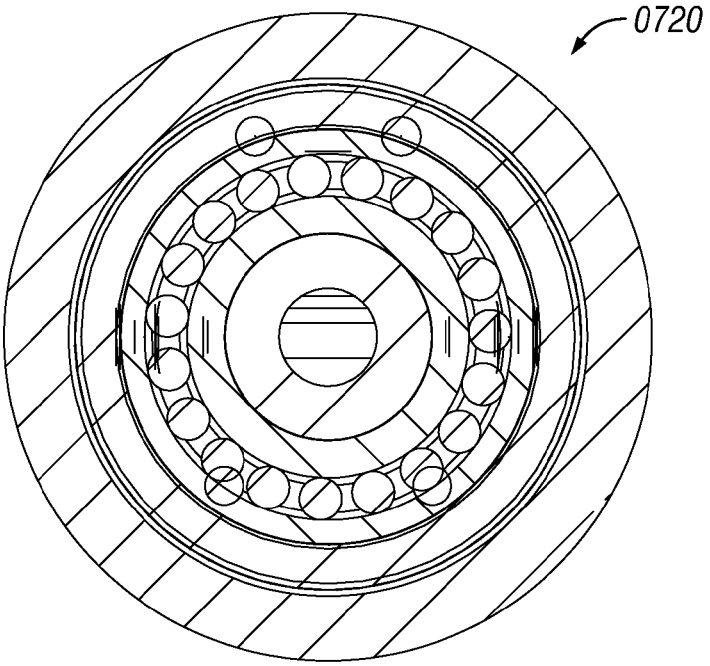
Figure 7C:
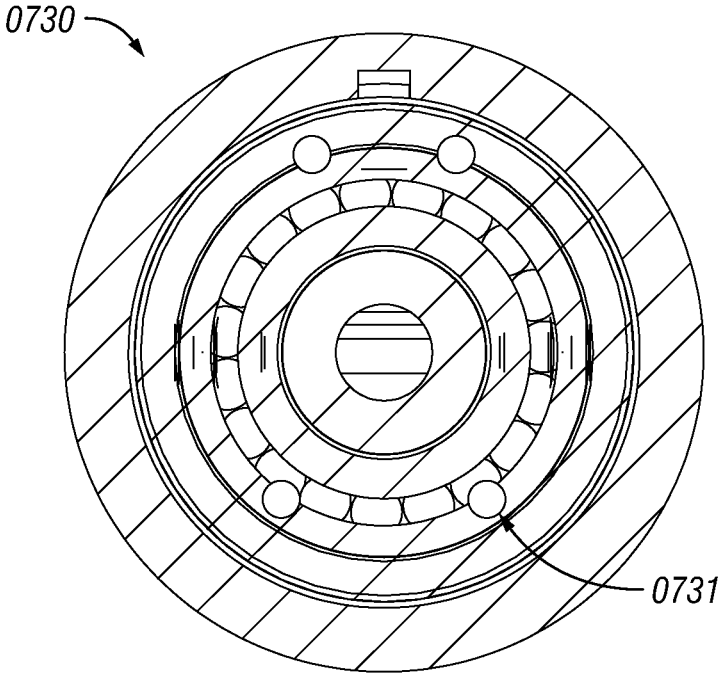
Figure 7D:
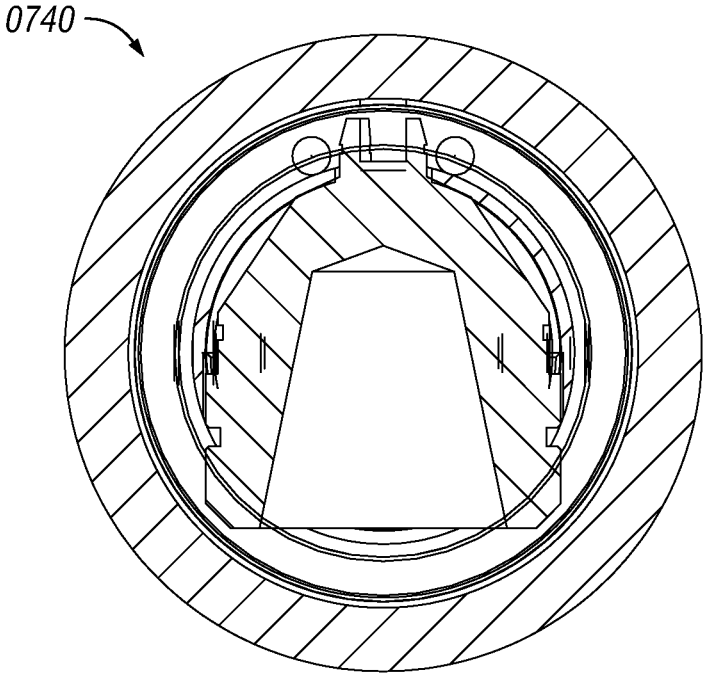
Figure 8:
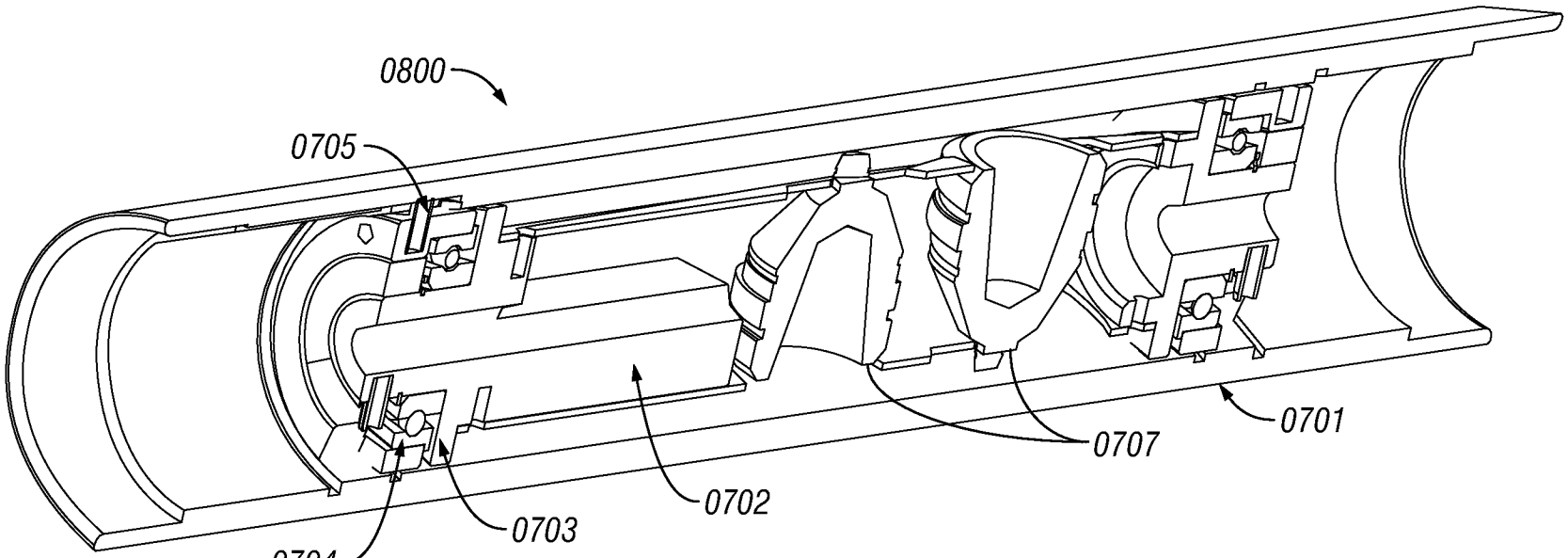
FIG. 8 illustrates a perspective view of limited internal rotation with ball bearing race to perform oriented perforation according to a preferred embodiment of the present invention.

As generally illustrated in FIG. 7 (0700), a perforating gun (0701) comprising a charge holder tube (CHT) (0703) carrying energetic charges (0707, 0708) is shown. The charge holder tube (0703) is mechanically coupled to the gun (0701) via bearing race system (0704). The CHT (0703) may be mechanically aligned to the gun barrel with an alignment pin (0705). A pin (0731) in the bearing race system (0704) limits the rotation/swivel of the CHT (0703) and therefore limits the rotation of the energetic charges (0707, 0708). According to a preferred exemplary embodiment, the pin (0731) acts as an internal pivot support that may be integrated to an end plate and is configured with a bearing race attached to a charge holder tube in the perforating gun. The pin (0731) limits rotation of said charge holder tube within a limited arc (0711) and orients energetic charges (0707, 0708) within a fine angular range in the desired perforation orientation. It should be noted that 2 charges are shown for illustration purposes only and may not be construed as a limitation. One skilled in the art would appreciate that any number of charges may be used in a perforating gun. According to an exemplary embodiment the pin (0731) limits the extent of the rotation of the charge holder tube and therefore the charges is limited to within +−5 degrees (fine angular range). An eccentric weight (0702) may also be used to orient the energetic charges in a preferred perforating direction. Prior art systems with bearing trace internal rotation enable a 360 degree movement, but the preferred embodiment limits the movement with the pivot pin (0731). The fine angular travel of the internal charge holder tube in combination with a coarse angular external orientation by an external protuberance member enables the energetic charges to accurately orient within +−5 degrees of the desired perforating orientation. FIG. 8 (0800) illustrates a perspective view of a perforating gun with an internal bearing race system that rotates within a limited arc due to the restriction of pin (0731) as shown in FIG. 7C.

Exemplary External Protuberance Member (EPM) in Conjunction with an Internal Pivot Support (IPS) Preferred Embodiment (0900-0920)

Figure 9A:
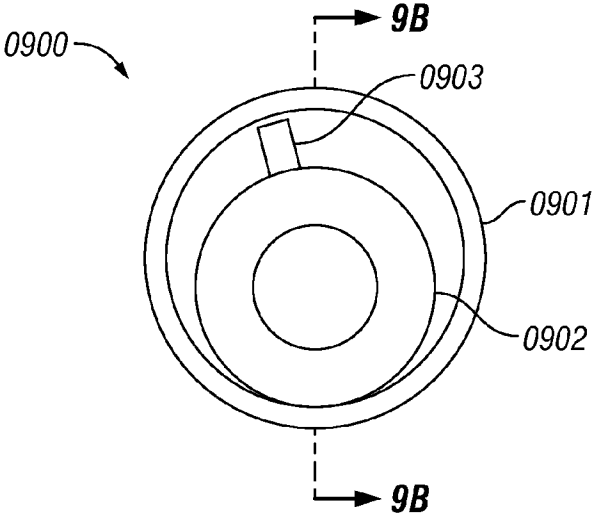
FIG. 9*a* illustrates an end view of an external protuberance member (EPM) mounted on gun string assembly in conjunction with an internal pivot support (IPS) and an external orienting weight to perform oriented perforation according to a preferred embodiment of the present invention.
Figure 9B:
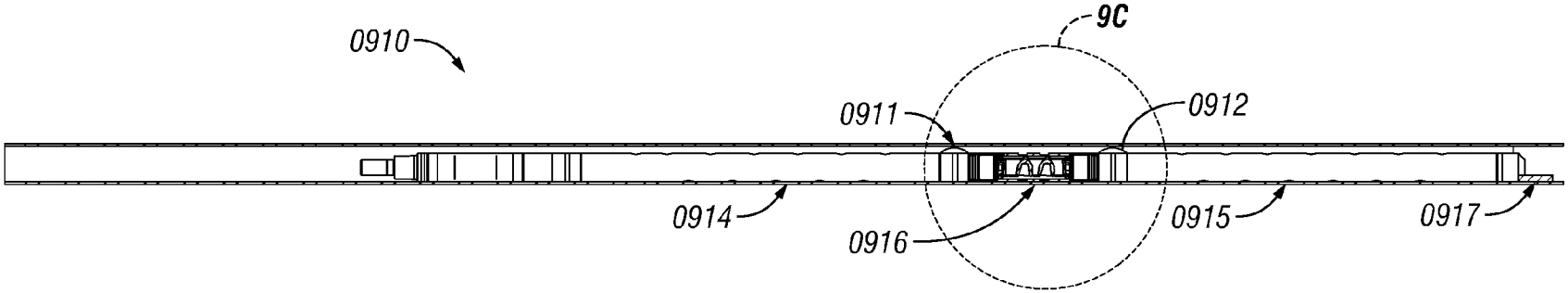
FIG. 9*b* illustrates a cross section view of an external protuberance member (EPM) mounted on a gun string assembly in conjunction with an internal pivot support (IPS) to perform oriented perforation according to a preferred embodiment of the present invention.

As generally illustrated in FIG. 9*a* (0900), a cross section end view of perforating gun string assembly (0902) in a wellbore casing (0901). An external protuberance member (EPM) (0903) may be mounted on the gun string assembly (0902) so that when deployed in a wellbore casing (0901), the guns are coarsely aligned within +/−20 degrees of the desired perforating orientation. A cross section of the gun string assembly (GSA) is further illustrated in FIG. 9*b* (0910) wherein, plural perforating guns (0914, 0915, 0916) are deployed into the wellbore casing (0901). External protuberance members (0911, 0912) may be mounted on the gun string assembly along with an external orienting weight (EOM) (0917). The external orienting weight (0917) may be used by itself to coarsely orient the perforating guns without the EPMs (0911, 0912). It should be noted that the external orienting weight (0917) may be integrated to the bull plug (toe end) of the GSA or to heel end of the GSA. According to a preferred exemplary embodiment, the external orienting weight (0917) may be used in conjunction with EPM (0911, 0912) to orient the GSA within +/−15 degrees of the desired perforating orientation. According to another preferred exemplary embodiment, the external orienting weight (0917) may be primarily used to orient the GSA within +/−15 degrees of the desired perforating orientation, with or without an external protuberance member. The weight of the EOM (0917) may be chosen such that the GSA orients within +/−15 degrees of the desired perforating orientation. A detailed view of perforating gun (0916) comprising an internal pivot support is further illustrated in FIG. 9*c* (0920).

Figure 9C:
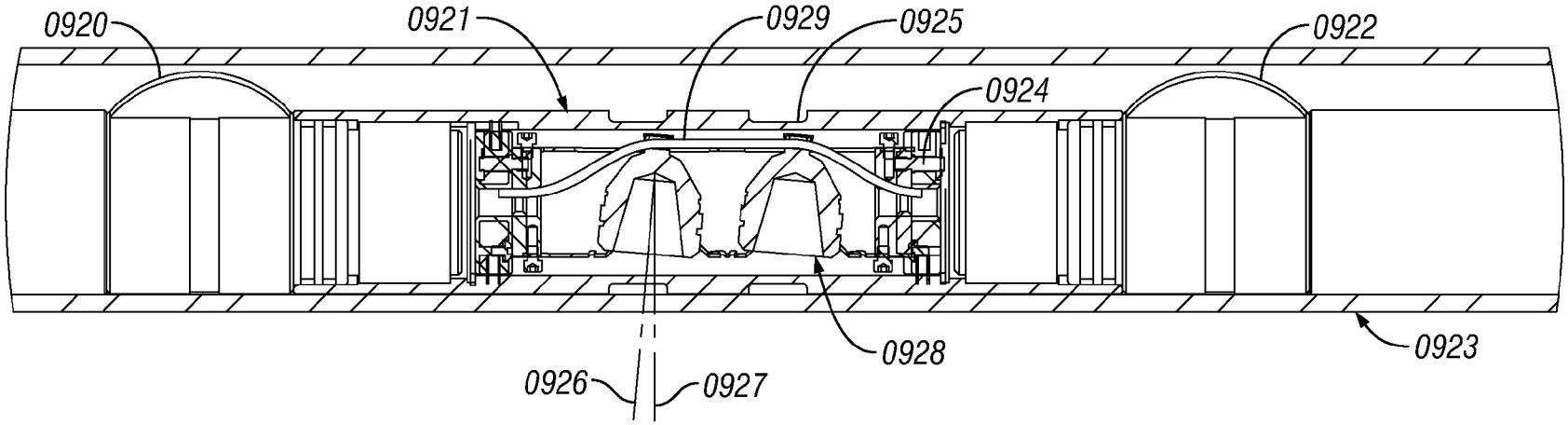
FIG. 9*c* illustrates an expanded cross section view of an external protuberance member (EPM) mounted on a gun string assembly in conjunction with an internal pivot support (IPS) to perform oriented perforation according to a preferred embodiment of the present invention.

As generally illustrated in FIG. 9*c* (0920), a perforating gun (0921) may be deployed into a wellbore casing (0923). The perforating gun (0921) may comprise an internal pivot support (IPS) (0924) operatively integrated to gun components such as a charge holder tube, an end plate in the charge holder tube, a charge case, and/or a charge clip that holds the charge case. An external protuberance member (EPM) (0922) may be mounted on the gun string assembly at a coupling location so that the perforating guns are coarsely aligned within +− 20 degrees of the desired perforating orientation (0927). According to a preferred exemplary embodiment, external protuberance member (0927) aligns energetic charges (0928) within a coarse angular range, while the internal pivot support further finely aligns the energetic charges (0928) within a fine angular range to the desired perforation orientation (0927). In a preferred exemplary embodiment the coarse angular range is within +/−20 degrees to the desired perforation orientation, while the fine angular range is within +−5 degrees to the desired perforation orientation. A secondary internal pivot support (SIPS) (0925) may also be integrated into the perforating gun (0921). The SIPS (0925) may be a clip, gimbal, trapeze or a wire suspended to a detonating cord (0929) or charge holder tube in the perforating gun (0921). The SIPS (0925) may enable the charge cases and the charges to swivel orthogonally and longitudinally to the wellbore casing (0923). The SIPS (0925) may further orient the charges to the desired perforation orientation to within a precise angular range. The precise angular angle may be within +/−5 degrees to the desired perforating orientation. Furthermore, the secondary internal pivot support (0925) may also orient orthogonally to correct for the imperfections of the wellbore casing itself. According to a preferred exemplary embodiment, the combination of external protuberance member, an internal pivot support and a secondary internal pivot support enables plural energetic charges to orient (0926) within +/−5 degrees to the desired perforating orientation (0927). According to yet another preferred exemplary embodiment, the combination of external protuberance member, an external orienting weight, an internal pivot support and a secondary internal pivot support enables plural energetic charges to orient (0926) within +/−5 degrees to the desired perforating orientation (0927). According to a further preferred exemplary embodiment, the combination of an external orienting weight, an internal pivot support and a secondary internal pivot support enables plural energetic charges to orient (0926) within +/−5 degrees to the desired perforating orientation (0927).

Preferred Exemplary System Block Diagram of an Oriented Wellbore Perforation with a Secondary Internal Pivot Support (IPS) (1000)

Figure 10:
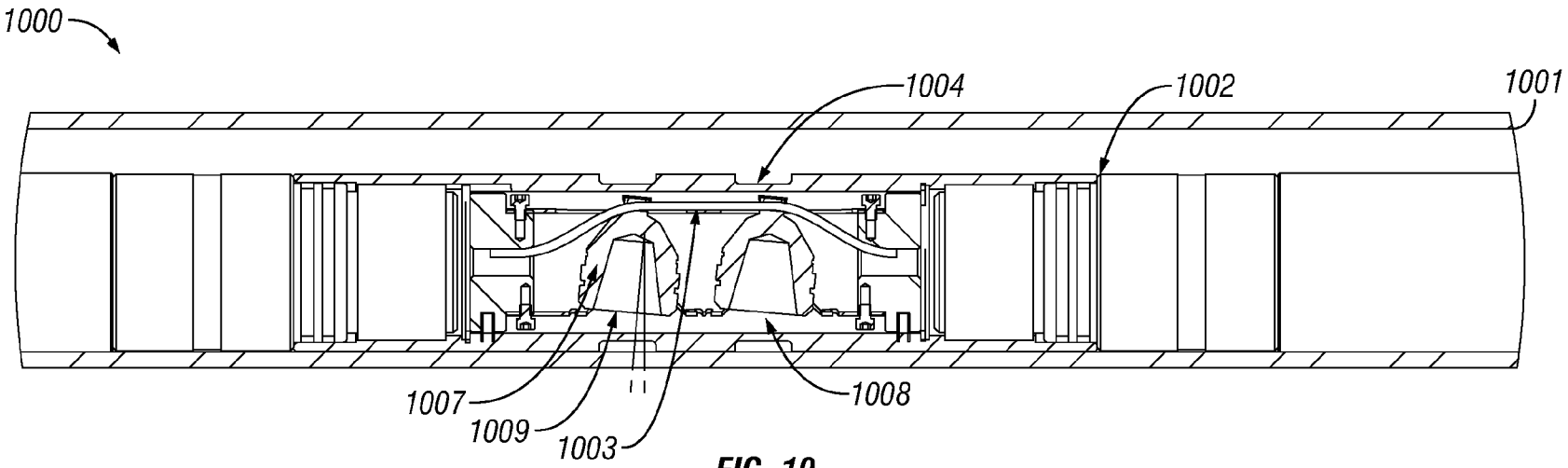
FIG. 10 illustrates an exemplary secondary internal pivot support (SIPS) system cross-section depicting a presently embodiment of the present invention.

As generally described above in FIG. 4 (0400), an internal pivot support may be a swivel element that rotates/spins/twists to permit a longitudinal and orthogonal movement of the charges as illustrated in FIG. 10 (1000). It should be noted that 2 charges are shown for illustration purposes only and may not be construed as a limitation. One skilled in the art would appreciate that any number of charges may be used in a perforating gun. After drilling a wellbore, a casing (1001) is installed horizontally inside the wellbore. The charges may be oriented to perforate at zero degrees to the preferred perforating orientation. The imperfections in the wellbore may cause the casing to be slightly angled/offset to the horizontal plane. Consequently, the gun string assembly may orient slightly away from the preferred fracturing direction. FIG. 10 (1000) shows a gun string assembly comprising a perforating gun (1002) that may be integrated with an EPM and a secondary internal pivot support SIPS (1004) suspended to a detonating cord (1003). The GSA may be deployed into a casing (1001) through a wireline or tubing coiled perforation (TCP). The IPS (1004) may be attached to a detonating cord on one end and to a charge case holder (1007) holding charges (1008, 1009) on the other end with a suspension member such as a wire. The IPS (1004) suspended on the detonating cord may enable limited arc movement of the charges (1008, 1009)

in both longitudinal (along the length of the casing) and orthogonal (perpendicular to the casing) axes. The limited movement of the charges in both directions permits the charges to adjust for the imperfections of the casing orientation inside a wellbore. According to a preferred exemplary embodiment, upon adjustment in both orthogonal and longitudinal directions, the charges may accurately orient to the preferred orientation for perforation resulting in higher perforation efficiency. The accuracy may be within +/−5 degrees to the preferred perforation orientation. According to a preferred exemplary embodiment, the external orientation of the perforating gun with the EPM along with the internal correction of the swivel IPS (1004) provides for an accurate perforation orientation within +/−5 degrees of the preferred/desired perforating orientation. The IPS (1004), the suspension member, and the EPM may be made of a material such as metal that can resist the temperature and pressure conditions of the wellbore and wellbore fluids. For example the material could be steel, aluminum.

Figure 11:
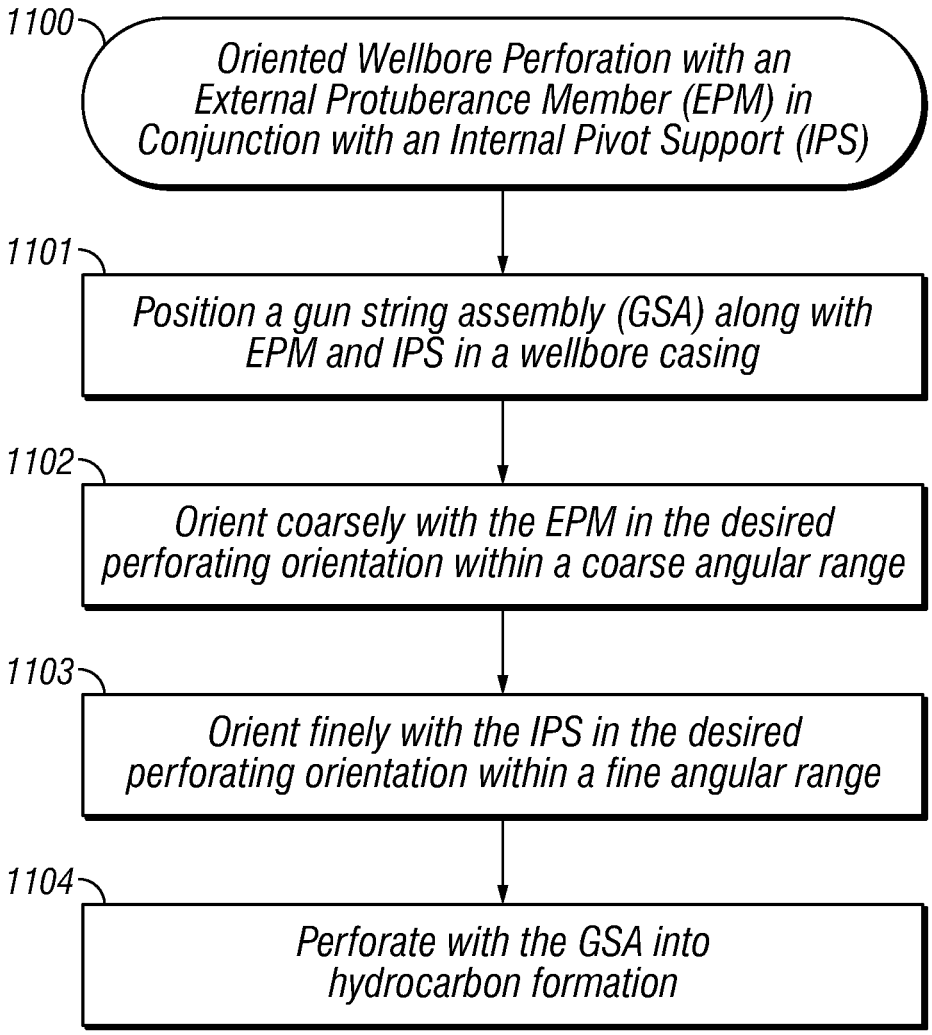
FIG. 11 illustrates a detailed flowchart of a preferred exemplary oriented wellbore perforation method with an external protuberance member (EPM) in conjunction with an internal pivot support (IPS) in some preferred exemplary invention embodiments.

Preferred Exemplary Flowchart Embodiment of an Oriented Wellbore Perforation with an External Protuberance Member As generally seen in the flow chart of FIG. 11 (1100), a preferred exemplary oriented wellbore perforation with an External Protuberance Member (EPM) in conjunction with an Internal Pivot Support (IPS) method may be generally described in terms of the following steps:

(1) positioning said GSA along with the EPM and the IPS in a wellbore casing (1101);

(2) orienting coarsely with the EPM in the desired perforating orientation within the coarse angular range (1102);

(3) correcting finely with the IPS in the desired perforating orientation within the fine angular range (1103); and (4) perforating with the GSA into a hydrocarbon formation (1104).

Preferred Exemplary System Rotated Spot Face Scallop Design (1200-1450)

The shaped energetic charges perforate through scallops on the outside of a perforating gun so that the burr created does not substantially protrude past the outside diameter of the perforating gun. Burrs on the outside may score the inside of the casing, or catch the restrictions along the way, when the perforating gun is pulled out causing preferential erosion points. The perforating gun is configured with a banded scallop design on the outside surface so that after internally correcting the shaped charge orientation with an internal pivot support, the shaped charges perforate through the banded scallops and not through the thick portion of the perforating gun. According to an exemplary embodiment, a band/channel that goes all the way around the perforating gun enables perforating charges to perforate through the scallop after the charges are oriented with IPS in the desired perforating orientation.

Rotated Snot Face Scallop Design (1200-1250)

Figure 12D:
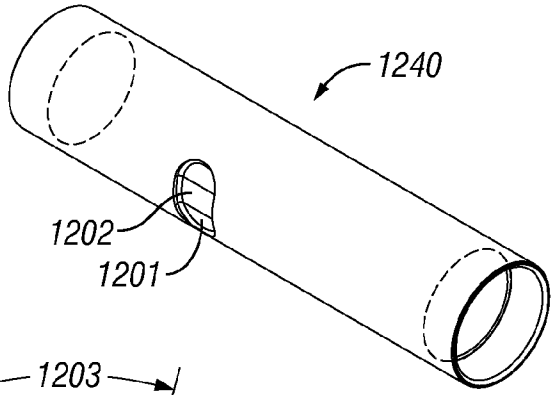
FIG. 12*a*, 12*b*, 12*c*, 12*d*, 12*e* illustrates different views of a rotated spot face scallop design for use in a perforating orienting gun according to a preferred exemplary embodiment.
Figure 12E:
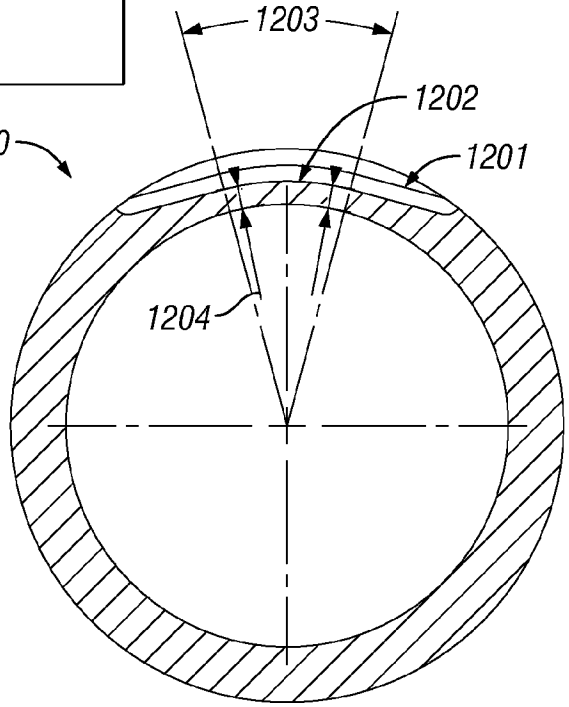
Figure 12B:
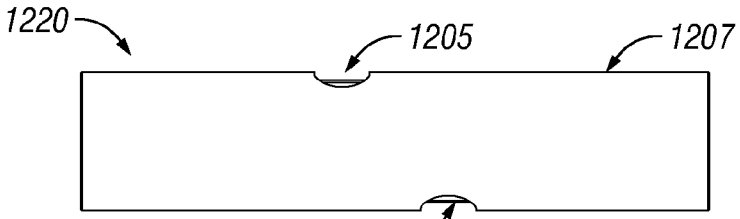
Figure 12C:
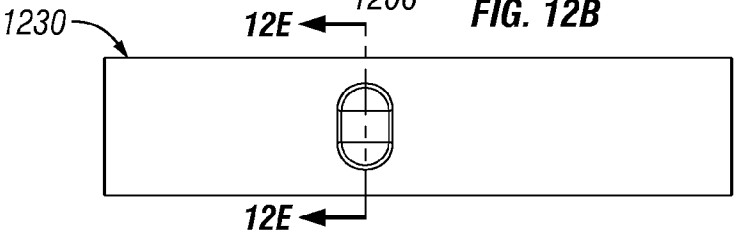
Figure 12A:
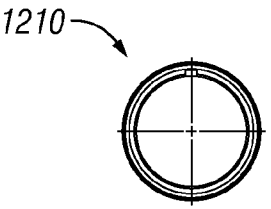

As illustrated in FIG. 12*a* (1210), FIG. 12*b* (1220), FIG. 12*c* (1230), FIG. 12*d* (1240), and FIG. 12*e* (1250) a rotated spot face scallops (1205, 1206) may be cut along a path on the outer surface of the perforating gun (1207). An end view of the scallop (1205) is illustrated in FIG. 12*c* (1230). A cross section of the scallop (1205) in FIG. 12*c* (1230) is further illustrated in FIG. 12*e* (1250). A perspective view of the rotated spot face scallops (1205, 1206) is illustrated in FIG. 12*d* (1240). As illustrated in FIG. 12*e* (1250), the rotated spot face scallops (elongated shaped scallops) may be configured with various angles (1203), widths (1201, 1202) and thickness (1204). According to a preferred exemplary embodiment, the angles may range from 0 degree to 180 degrees. According to a more preferred exemplary embodiment, the angles may be 45 degrees. According to another preferred exemplary embodiment, the width of the faces may range from 0.25 inches to 2 inches. According to a more preferred exemplary embodiment, the width may be 1.25 inches. According to another preferred exemplary embodiment, the thickness of the faces may range from 0.05 inches to 0.75 inches. According to a more preferred exemplary embodiment, the thickness may be 0.125 inches.

Eccentric Cut Scallop Design (1300-1350)

Figures 13A, 13B, 13C, 13D, 13E:
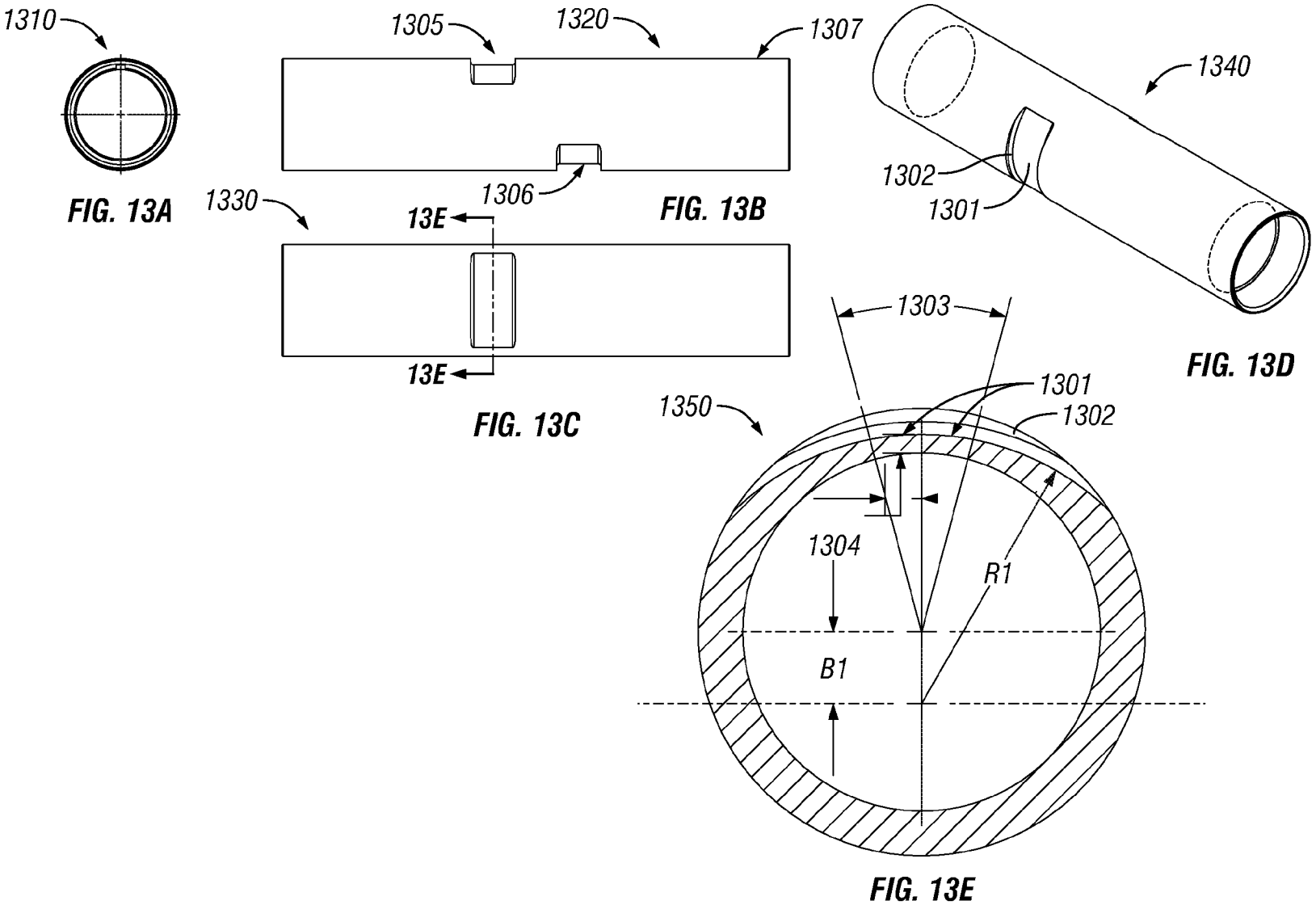
FIG. 13*a*, 13*b*, 13*c*, 13*d*, 13*e* illustrates different views of an eccentric cut scallop design for use in a perforating orienting gun according to a preferred exemplary embodiment.

As illustrated in FIG. 13*a* (1310), FIG. 13*b* (1320), FIG. 13*c* (1330), FIG. 13*d* (1340), and FIG. 13*e* (1350) an eccentric cut scallops (1305, 1306) may be eccentrically cut along a path on the outer surface of the perforating gun (1307). An end view of the scallop (1305) is illustrated in FIG. 13*c* (1330). A cross section of the scallop (1305) in FIG. 13*c* (1330) is further illustrated in FIG. 13*e* (1350). A perspective view of the eccentric cut scallops (1305, 1306) is illustrated in FIG. 13*d* (1340). As illustrated in FIG. 13*e* (1350), the eccentric cut scallops may be configured with various angles (1303), widths (1301, 1302) and thickness (1304). According to a preferred exemplary embodiment, the angles may range from 0 degree to 180 degrees. According to a more preferred exemplary embodiment, the angles may be 45 degrees. According to another preferred exemplary embodiment, the width of the faces may range from 0.25 inches to 2 inches. According to a more preferred exemplary embodiment, the width may be 1.25 inches. According to another preferred exemplary embodiment, the thickness of the faces may range from 0.05 inches to 0.75 inches. According to a more preferred exemplary embodiment, the thickness may be 0.125 inches.

Rotated True Scallop Design (1400-1450)

Figures 14A, 14B, 14C, 14D, 14E:
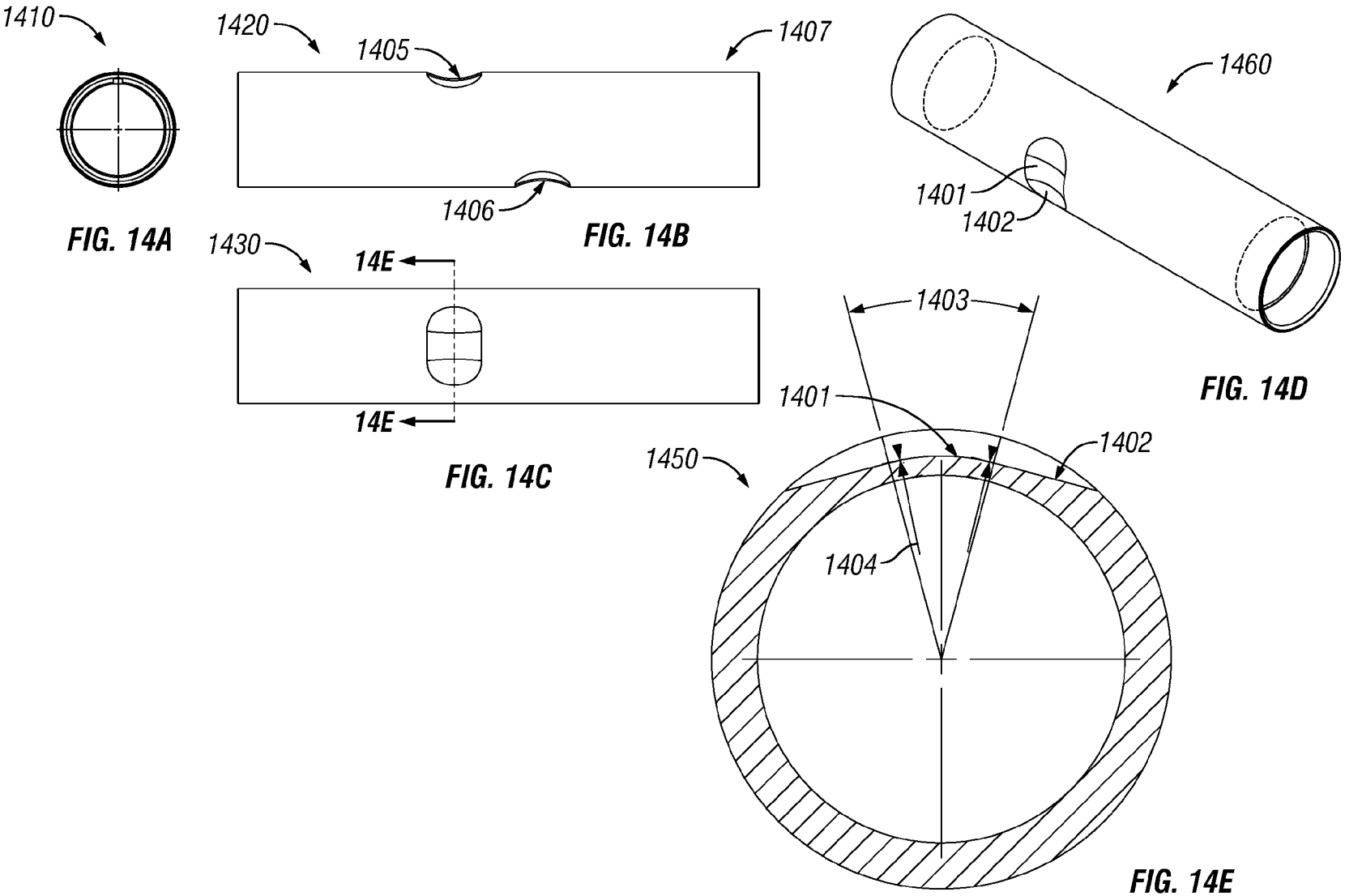
FIG. 14*a*, 14*b*, 14*c*, 14*d*, 14*e* illustrates different views of a rotated true scallop design for use in a perforating orienting gun according to a preferred exemplary embodiment.

As illustrated in FIG. 14*a* (1410), FIG. 14*b* (1420), FIG. 14*c* (1430), FIG. 14*d* (1440), and FIG. 14*e* (1450) a rotated true scallops (1405, 1406) may be cut along a path on the outer surface of the perforating gun (1407). An end view of the scallop (1405) is illustrated in FIG. 14*c* (1430). A cross section of the scallop (1405) in FIG. 14*c* (1430) is further illustrated in FIG. 14*e* (1450). A perspective view of the eccentric cut scallops (1405, 1406) is illustrated in FIG. 14*d* (1440). As illustrated in FIG. 14*e* (1450), the rotated true scallops may be configured with various angles (1403), widths (1401, 1402) and thickness (1404). According to a preferred exemplary embodiment, the angles may range from 0 degree to 180 degrees. According to a more preferred exemplary embodiment, the angles may be 45 degrees. According to another preferred exemplary embodiment, the width of the faces may range from 0.25 inches to 2 inches. According to a more preferred exemplary embodiment, the width may be 1.25 inches. According to another preferred exemplary embodiment, the thickness of the faces may range from 0.05 inches to 0.75 inches. According to a more preferred exemplary embodiment, the thickness may be 0.125 inches.

System Summary

The present invention system anticipates a wide variety of variations in the basic theme of oriented perforation, but can be generalized as an externally-oriented internally-corrected perforating gun system comprising:

(a) external protuberance member (EPM); and (b) internal pivot support (IPS);

wherein the perforating gun is at least part of a gun string assembly, the gun string assembly comprising a plurality of perforating guns;

the external protuberance member is configured to be mounted on the gun string assembly;

the external protuberance member is configured to externally align the perforating gun in a desired perforating orientation within a coarse angular range;

the internal pivot support is operatively integrated to internal components of the perforating gun; and the internal pivot support is configured to swivel plural energetic charges in the perforating gun within a limited arc such that the plural energetic charges are aligned within a finer angular range in the desired perforating orientation.

This general system summary may be augmented by the various elements described herein to produce a wide variety of invention embodiments consistent with this overall design description.

Method Summary

The present invention method anticipates a wide variety of variations in the basic theme of implementation, but can be generalized as an externally-oriented internally-corrected perforating gun method wherein the method is performed on an externally-oriented internally-corrected perforating gun system comprising:

(a) external protuberance member (EPM); and (b) internal pivot support (IPS);

wherein the perforating gun is at least part of a gun string assembly, the gun string assembly comprising a plurality of perforating guns;

the external protuberance member is configured to be mounted on the gun string assembly (GSA);

the external protuberance member is configured to externally align the perforating gun in a desired perforating orientation within a coarse angular range;

the internal pivot support is operatively integrated to internal components of the perforating gun; and the internal pivot support is configured to swivel plural energetic charges in the perforating gun within a limited arc such that the plural energetic charges are aligned within a finer angular range in the desired perforating orientation;

wherein the method comprises the steps of:

(1) positioning said GSA along with the EPM and the IPS in a wellbore casing;

(2) orienting coarsely with the EPM in the desired perforating orientation within the coarse angular range;

(3) correcting finely with the IPS in the desired perforating orientation within the fine angular range; and (4) perforating with the GSA into a hydrocarbon formation.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the internal pivot support is a pivot pin integrated to an end plate; the end plate is attached to a charge holder tube in the perforating gun; and the pivot pin limits rotation of the charge holder tube within the limited arc.

An embodiment wherein the internal pivot support is a pin integrated to an end plate; the end plate is configured with a bearing race attached to a charge holder tube in the perforating guns; and the pin limits rotation of the charge holder tube within the limited arc.

An embodiment wherein the internal pivot support is mechanically attached to a charge holder tube in the perforating gun.

An embodiment wherein the internal pivot support is mechanically attached to a detonating cord; the detonating cord is fastened to a charge holder tube in the perforating gun.

An embodiment wherein the internal pivot support is mechanically attached to a charge clip; the charge clip is suspending to a detonating cord fastened to a charge holder tube in the perforating gun.

An embodiment wherein the internal pivot support is mechanically attached to a charge case; the charge case is suspending to a detonating cord fastened to a charge holder tube in the perforating gun.

An embodiment the EPM is configured to be mounted at a plurality of coupling element locations of the perforating gun.

An embodiment the EPM is configured to be mounted on the perforating gun.

An embodiment the IPS is configured with eccentric weights to internally orient the charges in the desired perforating orientation.

An embodiment the finer angular range is within +– 5 degrees.

An embodiment wherein the coarser angular range is within +/−20 degrees.

An embodiment wherein the EPM shape is selected from a group consisting of: a cone, a taper, and an elongated shape.

An embodiment wherein the EPMs are angularly offset to each other.

An embodiment wherein the EPMs are randomly spaced.

An embodiment further comprises a secondary internal pivot support; the secondary internal pivot support is attached to a detonating cord in the perforating gun; the secondary internal pivot support is configured to swivel the plural charges along a longitudinal axis of the perforating gun to orient the charges within a precise angular range.

An embodiment further comprises a secondary internal pivot support; the secondary internal pivot support is attached to a detonating cord in the perforating gun; the secondary internal pivot support is configured to swivel the plural charges orthogonally to the length of the perforating gun to orient the charges within a precise angular range.

An embodiment wherein the precise angular range is within +/−5 degrees.

An embodiment wherein the precise angular range is within +/−5 degrees.

One skilled in the art will recognize that other embodiments are possible based on combinations of elements taught within the above invention description.

CONCLUSION

An externally-oriented internally-corrected perforating gun system and method for accurate perforation in a deviated wellbore has been disclosed. The system/method includes a gun string assembly (GSA) deployed in a wellbore with an external protuberance member (EPM) and an internal pivot support (IPS). With the EPM oriented to the high side of the wellbore, the center of mass of the GSA positions the GSA at the lower side of the wellbore surface. The IPS is attached to internal gun components such end plate, charge holder tube, detonating cord or charge case. The charges inside the charge holder tube move with the gravitational vector about the IPS and point more accurately in the desired direction for perforating. The external orientation of the EPM along with limited internal swing about the IPS provide for an accurate orientation of the charges that results in efficient and effective perforating through a hydrocarbon formation.

What is claimed is:

1. An externally-oriented internally-corrected perforating gun system for use in a wellbore casing comprising:

(a) external protuberance member (EPM); and (b) internal pivot support (IPS);

wherein said perforating gun system comprises a plurality of perforating guns;

said external protuberance member is configured to be mounted on said perforating gun system;

said external protuberance member is configured to externally align said perforating gun system in a desired perforating orientation within a coarse angular range; and said internal pivot support is configured to swivel plural energetic charges in said perforating gun system within a limited arc such that said plural energetic charges are aligned within a finer angular range in said desired perforating orientation.

2. The externally-oriented internally-corrected perforating gun system of claim 1 wherein said internal pivot support is a pivot pin integrated to an end plate; said end plate is attached to a charge holder tube in said perforating gun; and said pivot pin limits rotation of said charge holder tube within said limited arc.

3. The externally-oriented internally-corrected perforating gun system of claim 1 wherein said internal pivot support is a pin integrated to an end plate; said end plate is configured with a bearing race attached to a charge holder tube in said perforating guns; and said pin limits rotation of said charge holder tube within said limited arc.

4. The externally-oriented internally-corrected perforating gun system of claim 1 wherein said internal pivot support is mechanically attached to a charge holder tube in said perforating gun.

5. The externally-oriented internally-corrected perforating gun system of claim 1 wherein said internal pivot support is mechanically attached to a detonating cord; said detonating cord is fastened to a charge holder tube in said perforating gun.

6. The externally-oriented internally-corrected perforating gun system of claim 1 wherein said internal pivot support is mechanically attached to a charge clip; said charge clip is configured to mechanically attach a charge case to a detonating cord; said charge case is configured to house said plural energetic devices.

7. The externally-oriented internally-corrected perforating gun system of claim 1 wherein said internal pivot support is mechanically attached to a charge case; said charge case is configured to house said plural energetic charges.

8. The externally-oriented internally-corrected perforating gun system of claim 1 wherein said EPM comprises a plurality of EPM's that are configured to be mounted at a plurality of coupling element locations of said perforating gun system.

9. The externally-oriented internally-corrected perforating gun system of claim 1 wherein said EPM is configured to be mounted on at least one of said plurality of perforating guns.

10. The externally-oriented internally-corrected perforating gun of claim 1 wherein said IPS is configured with eccentric weights to internally orient said charges in said desired perforating orientation.

11. The externally-oriented internally-corrected perforating gun system of claim 1 wherein said finer angular range is within +/−5 degrees.

12. The externally-oriented internally-corrected perforating gun system of claim 1 wherein said coarser angular range is within +/−20 degrees.

13. The externally-oriented internally-corrected perforating gun system of claim 1 wherein said EPM shape is an elongated shape.

14. The externally-oriented internally-corrected perforating gun system of claim 1 wherein said EPM comprises a plurality of EPMs that are angularly offset to each other.

15. The externally-oriented internally-corrected perforating gun system of claim 1 wherein said EPM comprises a plurality of EPMs that are randomly spaced.

16. The externally-oriented internally-corrected perforating gun system of claim 1 further comprises a secondary internal pivot support; said secondary internal pivot support is attached to a detonating cord in said perforating gun; said secondary internal pivot support is configured to swivel said plural charges along a longitudinal axis of said perforating gun to orient said charges within a precise angular range.

17. The externally-oriented internally-corrected perforating gun system of claim 1 further comprises a secondary internal pivot support; said secondary internal pivot support is attached to a detonating cord in said perforating gun; said secondary internal pivot support is configured to swivel said plural charges orthogonally to the length of said perforating gun to orient said charges within a precise angular range.

18. The externally-oriented internally-corrected perforating gun system of claim 16 wherein said precise angular range is within +/−5 degrees.

19. The externally-oriented internally-corrected perforating gun system of claim 17 wherein said precise angular range is within +/−5 degrees.

20. The externally-oriented internally-corrected perforating gun system of claim 1 further comprises an external orienting weight; said external orienting weight is configured to be attached to an end of said perforating gun system.

21. An externally-oriented internally-corrected perforating gun method, said method operating in conjunction with an externally-oriented internally-corrected perforating gun system, said system comprising:

(a) external protuberance member (EPM); and (b) internal pivot support (IPS);

wherein said perforating gun system comprises a plurality of perforating guns;

said external protuberance member is configured to be mounted on said perforating gun system;

said external protuberance member is configured to externally align said perforating gun system in a desired perforating orientation within a coarse angular range; and said internal pivot support is configured to swivel plural energetic charges in said perforating gun system within a limited arc such that said plural energetic charges are aligned within a finer angular range in said desired perforating orientation;

wherein said method comprises the steps of:

(1) positioning said perforating gun system in a wellbore casing;

(2) orienting coarsely with said EPM in said desired perforating orientation within said coarse angular range;

(3) correcting finely with said IPS in said desired perforating orientation within said fine angular range; and (4) perforating with said perforating gun system into a hydrocarbon formation.

* * * * *